US006403270B2

(12) United States Patent
Itami et al.

(10) Patent No.: US 6,403,270 B2
(45) Date of Patent: Jun. 11, 2002

(54) ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, AND PROCESSING CARTRIDGE

(75) Inventors: Akihiko Itami; Hideo Yoshizawa; Masao Asano, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/735,741

(22) Filed: Dec. 13, 2000

(30) Foreign Application Priority Data

Dec. 13, 1999 (JP) ..... 11-353163
Dec. 13, 1999 (JP) ..... 11-353164

(51) Int. Cl.[7] ..... G03G 5/14
(52) U.S. Cl. ..... 430/59.5; 430/66; 399/350

(58) Field of Search ..... 430/59.5, 66, 67; 399/350

(56) References Cited

U.S. PATENT DOCUMENTS 5,688,620 A * 11/1997 Fujita et al. ..... 430/96
6,258,499 B1 * 7/2001 Itami ..... 430/66

FOREIGN PATENT DOCUMENTS

| | | |
|---|---|---|
| JP | 09190004 | 7/1997 |
| JP | 10083094 | 3/1998 |
| JP | 10251277 | 9/1998 |

* cited by examiner

*Primary Examiner*—John Goodrow
(74) *Attorney, Agent, or Firm*—Bierman, Muserlian and Lucas

(57) ABSTRACT

A cylindrical electrophotographic photoreceptor is disclosed. The layer thickness decreasing amount ΔHd (in $\mu$m) is $0 \leqq \Delta Hd < 5 \times 10^{-6}$ per rotatio,n and residual potential variation amount per $cm^2$ is $0 \leqq \Delta Vr < 100$ (in V) for 1 A of an electric current generated by charging and exposure.

21 Claims, 5 Drawing Sheets

ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, AND PROCESSING CARTRIDGE

FIELD OF THE INVENTION

The present invention relates to an electrophotographic photoreceptor (hereinafter occasionally referred to simply as a photoreceptor), and an electrophotographic image forming method, an electrophotographic image forming apparatus, and a processing cartridge.

BACKGROUND OF THE INVENTION

In recent years, widely employed as organic photoreceptors (hereinafter referred simply to as photoreceptors), have been organic photoreceptors. Compared to other photoreceptors, organic photoreceptors exhibit advantages in that it is easy to develop materials which correspond to various types of exposure light sources ranging from visible light to infrared rays; it is possible to select materials which result in minimum environmental pollution; their production cost is lower, and the like. However, said organic photoreceptors exhibit disadvantages in that the mechanical strength is insufficient, and while producing numerous copies and prints, the photoreceptor surface tends to be degraded or abraded.

Since electrical and mechanical external force is directly applied to the surface of electrophotographic receptors upon employing charging units, developing units, transfer means, cleaning units, and the like, durability is required to counter such force.

Specifically required is durability to resist wear and abrasion of the photoreceptor surface due to friction, surface degradation due to active oxygen such as ozone, nitrogen oxides, and the like, which are generated during corona charging.

Heretofore, in order to improve the durability of organic photoreceptors, it has primarily been desired to minimize the wear due to sliding of cleaning blades and the like. In order to achieve said target, techniques have been investigated in which a very strong protective layer is applied onto the photoreceptor surface, and the like. For example, Japanese Patent Publication Open to Public Inspection Nos. 9-190004 and 10-251277 describe photoreceptors in which siloxane resins having a pronounced strength are employed in the surface layer. However, new problems are arisen because the highly strong protective layer comprised of the siloxane resins have low wear.

When the same organic photoreceptor is repeatedly used over an extended period of time, the residual potential increases due to its degradation caused by light, oxidation due to products formed by discharge, and the like. For example, an electric field generated by said residual potential results in electrostatic adhesive forces between paper dust which is charged with a polarity opposite to that of the photoreceptor. As a result, the adhesion of paper dust onto the photoreceptor surface is increased. Said adhered paper dust works as nuclei in such a manner that toner components and the like, such as fine toner particles and so on, are firmly adhered onto the photoreceptor surface, and photoreceptor filming is generated which may not be removed during a cleaning process. In the photoreceptor which exhibits a greater wear rate than the adhesion rate of paper dust and the like, it is possible to sufficiently remove electrostatically adhered materials. However, in photoreceptors which exhibit a lower wear rate as well as higher surface hardness, the adhesion rate exceeds the wear rate. As a result, said photoreceptor filming occurs.

In order to minimize said filming, heretofore, a decrease in physical adhesive force has been attempted by decreasing the surface energy of the protective layer. For example, Japanese Patent Publication Open to Public Inspection No. 10-83094 describes a method to use a protective layer having a small surface energy which results in a contact angle between the surface of the photoreceptor and water of at least 90 degrees. However, in the reversal development system in which during the transfer process, transfer media are charged in an opposite polarity to the photoreceptor, adhesive materials such as paper dust, and the like, generated from transfer media are charged in an opposite polarity to the photoreceptor and as a result, electrostatic adhesive force is generated between adhesive materials and the photoreceptor. Accordingly, it has been difficult to minimize the electrostatic adhesion of foreign materials, if the physical adhesive force of the photoreceptor surface is only decreased.

In order to overcome this drawback, investigation has been carried out. As a result, it has been discovered that by controlling an increase in the residual potential of the photoreceptor within the predetermined range, it is possible to minimize filming of developer materials as well as paper sheets. Further, it has been discovered that it is important to specifically control the rate of increase in the residual potential of the photoreceptor within a certain range with respect to the rate of the abrasive wear of the photoreceptor.

SUMMARY OF THE INVENTION

It is an object of the present invention to provide an electrophotographic photoreceptor which exhibits high durability and results in high image quality, and in more detail, to provide an electrophotographic photoreceptor which exhibits excellent stability of electric potential and minimizes filming, and to provide an electrophotographic image forming method, an electrophotographic image forming apparatus, and a processing cartridge employed in said apparatus.

The invention and its embodiments are described below.

1. An electrophotographic photoreceptor comprising a cylindrical electrically conductive support having thereon a plurality of layers, wherein layer thickness decreasing amount $\Delta Hd$ (in $\mu m$) is $0 \leqq \Delta Hd < 5 \times 10^{-6}$ per rotation, and residual potential variation amount is $0 \leqq \Delta Vr < 100$ (in V) in the case an electric current corresponding to 0.1 $C/cm^2$ is provided to a surface of said photoreceptor by charging and exposure.

One of a plurality of said resinous layers is preferably a surface layer, and said surface layer comprises a siloxane based resin containing structural units having charge transportability.

The surface layer preferably comprises colloidal silica.

The surface layer preferably comprises an antioxidant.

The cylindrical electrically conductive support preferably comprises a sublayer, a charge generating layer, a charge transport layer and the surface layer.

The charge generating layer comprises preferably titanyl phthalocyanine having a maximum peak at a Bragg angle of 27.2 degrees with respect to the Cu-K$\alpha$ line.

The contact angle between the surface of the photoreceptor and purified water is preferably at least 90 degrees.

The electrophotographic image forming method comprising process of charging, image exposure, development, transfer and cleaning utilizing a blade, and employing an electrophotographic photoreceptor which comprises a cylindrical electrically conductive support having thereon a plurality of resinous layers, wherein when the image forming process is carried out by rotating said electrophotographic photoreceptor more than 300,000 times under conditions in which average toner amount adhered onto entire surface of said electrophotographic photoreceptor through development during said development process is at least 0.5 mg/cm$^2$, a layer thickness decrease amount ΔHd (in μm) per rotation is $0 \leqq \Delta Hd < 3\times10^{-6}$, and residual potential variation amount ΔVr (in V) per rotation is $0 \leqq \Delta Vr < 1\times10^{-5}$.

In the image forming method one of said plurality of layers is preferably a surface layer comprising siloxane based resin having structural units exhibiting charge transportability.

The cleaning blade, which is employed in said blade cleaning process, has preferably a hardness of 65 to 75 degrees and an impact resilience of 15 to 60 percent, and is brought into contact with said photoreceptor under a linear pressure of 5 to 50 g/cm.

The toner of a developer material employed in said development process is preferably blended with powder having a number average particle diameter of 10 to 300 nm as the external additive and external additive adhesion ratio Fd is between 10 and 90 percent, wherein $$Fd=[1-\{Sw_1-Sw_2\}/Sw_3]]\times100$$

in the formula $Sw_1$ is the BET specific surface area (in m$^2$/g) of toner adhered to the external additive, $Sw_2$ is the BET specific surface area (in m$^2$/g) of toner prior to the addition of the external additive, and $Sw_3$ is the BET specific surface area (in m$^2$/g) of the external additive.

The toner of the developer material employed in said development process is preferably blended with powder having an average particle diameter of not more than 50 nm, and with powder having an average particle diameter of at least 60 nm in combination as the external additives.

The development process may employ the reversal development system.

In the image forming method the surface layer of the electrophotographic photoreceptor preferably comprises colloidal silica.

The surface layer preferably comprises an antioxidant.

The cylindrical electrically conductive support preferably comprises a sublayer, a charge generating layer, a charge transport layer and said surface layer.

In the electrophotographic photoreceptor the charge generating layer preferably comprises titanyl phthalocyanine having a maximum peak at a Bragg angle of 27.2 degrees with respect to the Cu-Kα line.

The contact angle between the surface of the photoreceptor and water is at least 90 degrees.

The electrophotographic photoreceptor is preferably repeatedly employed over at least 1,000,000 rotations for forming images.

An electrophotographic image forming apparatus comprising charging member, image exposure member, development member, transfer member and cleaning member utilizing a blade, and an organic electrophotographic photoreceptor which comprises a cylindrical electrically conductive support, having thereon a photosensitive layer, wherein when image forming process is carried out by rotating said electrophotographic photoreceptor more than 300,000 times under the conditions in which an average toner amount, adhered onto an entire surface of said electrophotographic photoreceptor comprising said surface layer, is at least 0.5 mg/cm$^2$, through development of said development means, a layer thickness decrease amount ΔHd (in μm) per rotation is $0 \leqq \Delta Hd < 3\times10^{-6}$, and residual potential variation amount ΔVr (in V) per rotation is $0 \leqq \Delta Vr < 1\times10^{-5}$.

In the electrophotographic image forming apparatus, one of said plurality of layers is preferably a surface layer comprising siloxane based resin having structural units exhibiting charge transportability.

BRIEF DESCRIPTION OH THE DRAWINGS

FIG. 1 (*b*) is a view showing the relationship between a blade and a photoreceptor to explain the formula.

DETAILED DESCRIPTION OF THE INVENTION

The electrophotographic photoreceptor of the present invention is a cylindrical electrophotographic photoreceptor, and said electrophotographic photoreceptor, which is repeatedly rotated to form images, is subjected to wear, resulting in an increase in the residual potential. The present invention is characterized in that the layer thickness decrease amount per rotation ΔHd (in μm) is represented by $0 \leqq \Delta Hd < 5\times10^{-6}$, and when charging and exposure are repeated and an electrical current of 0.1 C/cm$^2$ is allowed to flow, a residual potential variation amount ΔVr per cm$^2$ is represented by $0 \leqq \Delta Vr < 100$. (in V).

Layer thickness decrease amount ΔHd (at an ambience of normal temperature and normal humidity (20° C. and RH 50 percent)

In the present invention, the layer thickness decrease amount per rotation ΔHd (in μm) is the value obtained by carrying out the wear test described below.

The present invention will now be detailed in the following.

In the electrophotographic image forming method of the present invention, the layer thickness decrease amount ΔHd (in μm) per rotation of the electrophotographic photoreceptor employed in said image forming method is $0 \leqq \Delta Hd < 3\times10^{-6}$, and the residual potential variation amount ΔVr (in V) per rotation is $0 \leqq \Delta Vr < 1\times10^{-5}$.

Layer thickness decrease amount ΔHd (in μm) per rotation

In the present invention, the layer thickness decrease amount ΔHd (in μm) per rotation of the electrophotographic photoreceptor, as described herein, means a value obtained in such a manner that a series of image forming processes comprising charging, image exposure, development, transfer, and cleaning utilizing a blade are carried out under at least 300,000 rotations, and the resultant layer thickness variation amount (in μm) is divided by the total number of rotations. Incidentally, in the examples described below, the layer thickness of the photoreceptor was also measured employing the method described below.

Figure 1:
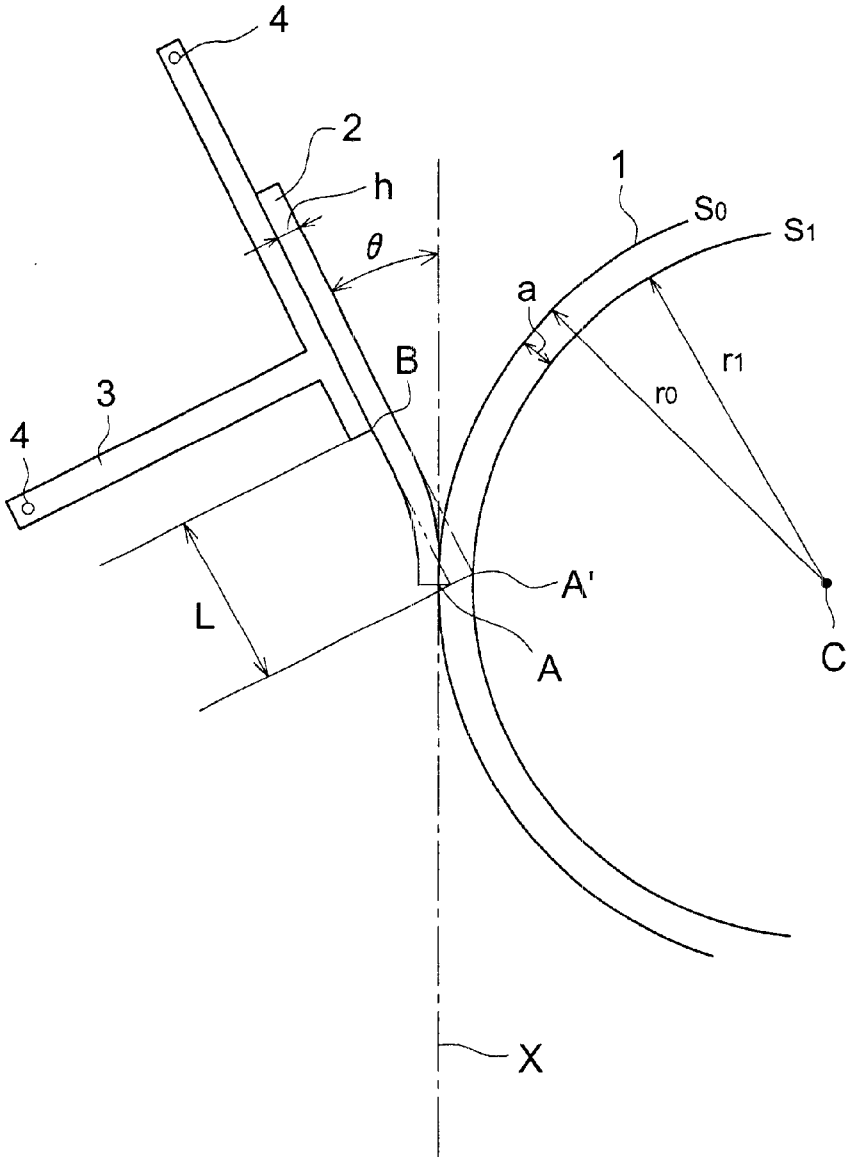
FIG. 1 (*a*) is a view showing the contact conditions of a cleaning blade with a photoreceptor.
Figure 1:
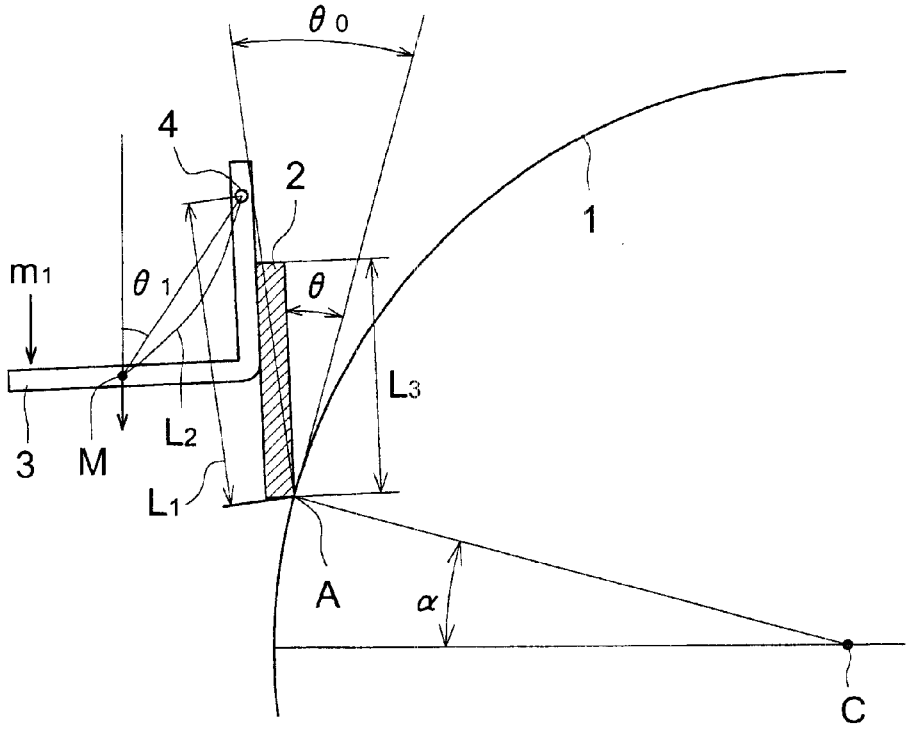

FIG. 1 (*a*) is a view explaining the contact conditions of a cleaning blade with the photoreceptor in said wear test.

In FIG. 1 (*a*), reference numeral 1 is a photoreceptor and θ is the contact angle. Further, as shown in FIG. 1 (*a*), free length L of said cleaning blade 2 represents the length from the end of support member 3 to the end point of said blade prior to its deformation.

Reference numeral 4 is a screw to secure support member 3, while "h" is the thickness of said blade.

Further, contact angle θ is the angle between the tangential line at contact point A of said photoreceptor and the blade prior its deformation (in FIG. 1 (*a*), shown as a dotted line).

Further, as shown in FIG. 1 (*a*), thrust amount "a" is the difference between radius $r_0$ of the external circumference of a photoreceptor and radius $r_1$ of circle $S_1$, having, as the center, central axis C of said photoreceptor which is located at position A' of the blade prior to its deformation (in FIG. 1 (*a*), shown as a dotted line).

The physical property parameters, hardness and impact resilience of the rubber blade, comprised of elastic materials which are employed for said cleaning blade, are measured employing JIS A Hardness and Physical Test Method of Vulcanized Rubber JIS K6301, respectively.

The cleaning blade employed in the present invention may be made of silicone rubber, urethane rubber, and the like, but a blade made of urethane rubber is most preferable.

Further, the adhesion amount of toner as described herein means the weight of the toner per $cm^2$, which is developed on the photoreceptor surface, by bias development employing a development unit. In the wear test of the present invention, it corresponds to the toner amount per $cm^2$ which is removed by the cleaning blade.

The adhesion amount of toner is obtained as follows. Toner, which is adhered onto the photoreceptor surface through development, is transferred onto an adhesive tape and the weight difference of said tape is obtained before and after the transfer of the toner, and the resultant difference is converted to a per $cm^2$ volume.

<Wear Test>

An electrophotographic photoreceptor connected to a driving section was brought into contact with a cleaning blade having a hardness of 70±3°, an impact resilience of 35±5 percent, a thickness of 0.2 mm, and a free length of 9±0.3 mm under conditions of a contact angle of 10±0.5 degrees in the counter direction and a thrust amount of 1.5±0.5 mm. While rotating said electrophotographic photoreceptor employing said driving section so that one rotation is completed within 0.1 to 10 seconds, toner particles having a volume average particle diameter of 8.5±0.5 μm, which was blended with powder having a number average particle diameter of 10 to 40 nm as the external additive, in an amount of 1±0.2 percent by weight with respect to said toner, was subjected to development so as to result in an adhered amount of 0.15±0.05 $mg/cm^2$. After development, said toner particles were removed. When said electrophotographic photoreceptor was subjected to at least 100,000 rotations, the layer thickness variation amount of said photoreceptor was measured and the value obtained by dividing the resultant amount by the number of rotations was designated as the layer thickness decreasing amount per rotation.

The specific example of the layer thickness decrease amount measurement of the present invention is described below. A Konica 7040 digital copier, manufactured by Konica Corp., was modified, and a wear tester, which only comprised a development section and a cleaning section, was prepared. Said cleaning section was brought into contact with a cleaning blade having a hardness of 70°, an impact resilience of 35 percent, a thickness of 2 mm, and a free length of 9 mm, under conditions of a contact angle of 10 degrees in the counter direction and a thrust amount of 1.5 mm. Subsequently, while rotating a 60Φ mm cylindrical electrophotographic photoreceptor at a linear speed of 210 mm/second, development was carried out so as to realize an adhered toner amount of 0.1 to 0.2 $mg/cm^2$, utilizing the potential difference between the bias potential of the development section and a photoreceptor which was grounded. Employed as toner was, for example, one having a volume average particle diameter of 8.5 μm, blended with titanium oxide having a number average particle diameter of 30 nm, and hydrophobic silica powder having a number average particle diameter of 12 nm (the ratio of titanium oxide to silica was 3/2 in terms of the weight ratio) as the external additives in an amount of one percent by weight with respect to said toner. Employing said toner, cleaning was carried out. Under said conditions, said electrophotographic photoreceptor was rotated at least 100,000 times at an ambience of normal temperature and normal humidity (20 ° C. and 50 percent RH), and the development-cleaning process was repeatedly carried out. Then the layer variation amount (difference form the initial layer thickness) of said photoreceptor was measured. The measured value was divided by the number of rotations of said photoreceptor, and the resultant value was designated as the layer thickness decrease value per rotation.

*Measurement Method of Layer Thickness

Ten locations of a photosensitive layer having a uniform thickness were randomly selected and the layer thickness at said locations was measured. The average of said obtained thickness was designated as the layer thickness. Employed as the layer thickness measurement device was an eddy current system layer thickness measurement instrument, Eddy 560C (manufactured by Helmut Fischer GMTE) was employed. Residual Potential Variation Amount (at an ambience of normal temperature and normal humidity (20° C. and RH 50 percent))

On the other hand, the residual potential generally means minimum potential obtained from the photoreceptor charged at 300 V or more in terms of an absolute value which is subjected to ordinary exposure. Specifically, it shows surface potential at the time when a curved line which is obtained by plotting an exposure amount on the abscissa and the surface potential of the photoreceptor on the ordinate, shows minimum change. However, in the present invention, said residual potential is defined as described below.

Namely, the residual potential as described herein is defined as the surface potential which is obtained within one minute from one second after exposing a photoreceptor charged at 300 to 900 V in terms of the absolute value, employing light in an amount of a factor of 10 to 50 times of the half decay exposure amount.

It is possible to obtain said residual potential variation amount from the difference between the initial residual potential (the value measured when charging and light exposure having an amount between 10 and 50 times of the half decay light exposure amount are carried out once) of the prepared photoreceptor and the residual potential measured after the integral value of the electric current, which flows into said photoreceptor, reaches 0.1 Coulomb) per $cm^2$ upon repeatedly carrying out said charging and light exposure (having a light amount between 10 and 50 times of the half decay exposure amount). the interval between said charging and said exposure is adjusted to no less than 0.1 second so that said charging and said exposure do not overlap. Further, one cycle of said charging and said exposure is adjusted to between 0.1 and 10 seconds, and said charging and said exposure are continuously repeated, except for the period when the variation amount is measured. Employed as the residual potential is the value which is measured within 10 minutes after said integral value of the running-in electric current reaches 0.1 Coulomb per $cm^2$.

Said integral value of the running-in electric current, as described herein, means the total electric current, which has flown into the interior of the photoreceptor from the electrically conductive support during the process in which charging and light exposure are repeatedly carried out. In the present invention, it is possible to obtain said integral value by measuring the charge amount per unit time which has run into the cylindrical photoreceptor from the earth through the grounded cylindrical electrically conductive support is measured and by obtaining the product of the obtained charge amount and the time in which the potential is attenuated. It is possible to obtain the integral value of the running-in electric current per $cm^2$ by dividing the total electric current value which has run into the cylindrical photoreceptor by the surface area of said cylindrical photoreceptor. Further, it is possible to measure said charge amount per unit time, employing an ammeter connected to a grounded cable, which is employed for grounding said cylindrical electrically conductive support.

Further, said half decay exposure amount, as described herein, is defined as the exposure amount which is necessary for attenuating surface potential V of the photoreceptor to ½ of the charging potential $V_0$ from charging potential $V_0$. Specifically obtained is the product of the required time in which the surface potential reaches $V_0/2$, upon providing light irradiation onto the photoreceptor charged at $V_0$ V with light having constant energy (the relationship between the wavelength and the emitting light intensity) and energy. In that case, a potential decay part (dark decay part) which occurs during dark electric discharge is compensated. It is possible to calculate the half decay exposure amount employing the resultant product.

A specific example of residual potential measurement will now be described. A Konica 7040 digital copier, manufactured by Konica Corp., was modified, and a potential evaluation device was prepared which was comprised of a charging section as well as an LED exposure section and in which a surface electrometer was installed between said LED exposure section and the charging electrode with respect to the photoreceptor rotation direction. At an ambience of normal temperature and normal humidity (20° C. and 50 percent RH), the initial charging potential was set at −750 V, and the surface potential was obtained which was obtained one second after exposure employing LED light irradiation having a light amount of 10 times of the half decay exposure amount and the initial residual potential was determined. Subsequently, charging and LED light exposure were repeatedly carried out. While monitoring the electric current which was flowing into the photoreceptor, repetition was carried out until the integral value of the running-in electric current reached 0.1 C per unit area. After reaching 0.1 C, the residual potential value of the photoreceptor was obtained in the same manner as the initial potential. The variation amount was calculated employing the difference between the obtained residual potential and the initial residual potential.

Said residual potential variation amount ΔVr (in V) per rotation means the value which is obtained in such a manner that image forming processes of at least 300,000 times are carried out employing an electrophotographic receptor in the same image forming apparatus, and the difference between the residual potential measured prior to the first rotation and the residual potential measured after the final image forming rotation is divided by the total number of rotations of the photoreceptor employed for said image forming processes.

In the present invention, said layer thickness decrease amount ΔHd (in μm) per rotation of the electrophotographic photoreceptor, as well as said residual potential variation amount ΔVr (in V) per rotation, is a extremely small value. Therefore, in order to obtain more accurate values, it is necessary that after carrying out image forming processes of at least 300,000 rotations on said electrophotographic photoreceptor, said electrophotographic photoreceptor is removed from the image forming processes, and respective values of the layer thickness and the residual potential are obtained.

On the other hand, "under the conditions in which image formation is carried out so that the average toner amount adhered onto the entire surface of said electrophotographic photoreceptor through development during said development process is at least 0.5 $mg/cm^2$", as described herein, means that the image forming method of the present invention regulates conditions which are generally and widely employed for image formation. Thus, the image forming method of the present invention is not considered to be one in which a number of sheets are copied under conditions in which no images are formed. Further, said image forming processes of at least 300,000 rotations may be carried out either continuously or intermittently.

Further, the ambient conditions of temperature and humidity for the image processing method of the present invention may be those of typical offices where image formation is generally carried out. It is supposed that said image formation is carried out at temperatures of 0° C. to 40° C. and at humidity of 10 percent. Thus, it is necessary that said layer thickness decrease amount as well as said residual potential variation amount is achieved under such conditions.

Preferred as the image forming method to reduce said layer thickness decrease amount as well as said residual potential variation amount, so as to be within the range of the present invention, is one described below. However, other image forming methods may be employed. Electrophotographic photoreceptors, which are preferably employed in the image forming method of the present invention, and related image forming processes, will now be described.

In electrophotographic image forming methods, the layer thickness decrease amount ΔHd (in μm) per rotation of the electrophotographic photoreceptor is determined depending mainly on factors such as the layer strength (A) of the electrophotographic photoreceptor employed for said image forming method, on properties as well as contact conditions (B) of the cleaning blade employed during the cleaning process, and on toner (C) which slides the photoreceptor surface together with the cleaning blade.

On the other hand, it is has been supposed that said residual potential variation amount ΔVr (in V) is determined mainly depending on factors such as electrophotographic properties of the photoreceptor during the repetition of charging and exposure, and especially on the degradation of the carrier generating capability and the carrier mobility (D).

In order to adjust the layer thickness decrease amount ΔHd (in μm) as well as the residual potential variation amount ΔVr (in V) per rotation of the electrophotographic photoreceptor to be within the range of the present invention, it is therefore important to control the four leading factors of (A), (B), (C), and (D). The electrophotographic photoreceptors, properties and contact conditions of the cleaning blade, and of the toner, which are preferably employed in the present invention, will now be detailed.

For the present invention, it is required to develop an electrophotographic photoreceptor having excellent properties such that when the layer thickness decrease amount is small, the residual potential variation amount is also small. As a photoreceptor which satisfies both, the inventors of the present invention have developed an electrophotographic photoreceptor having as the surface layer a siloxane based resinous layer exhibiting the charge transportability described below.

Image forming processes which relate to the electrophotographic photoreceptor of the present invention will now be described.

In the electrophotographic photoreceptor of the present invention, excellent properties, such as the surface layer strength with high hardness and the minimum increase in the variation of the residual potential, are achieved by synergistic effects of formulas of the siloxane based resinous surface layer, having charge transportability, the photosensitive layer and the sublayer.

The constitution of the electrophotographic photoreceptor of the present invention will now be described.

Cylindrical Electrically Conductive Support

The cylindrical electrically conductive support as described in the present invention means a cylindrical support which is capable of continuously forming images by repeated rotation. The electrically conductive support, having a true circularity degree in the range of not more than 0.1 mm as well as a fluctuation in the range of 0.1 mm, is preferable. When said circularity as well as fluctuation exceeds said range, it becomes difficult to prepare excellent images.

Employed as electrically conductive materials may be metal drums comprised of aluminum, nickel, and the like, plastic drums evaporated with aluminum, tin oxide, indium oxide, and the like, or paper•plastic drums coated with these kinds of electrically conductive materials. Said electrically conductive supports preferably exhibit a specific resistance of $10^3$ Ωcm or more.

The cylindrical electrically conductive support having thereon at least two resinous layers, as described in the present invention, means a cylindrical electrically conductive support having thereon at least two layers in which resins exhibit major function for the layer formation, and said resinous layer is comprised of at least two of a sublayer, a photosensitive layer, as well as, in addition, a charge generating layer, a charge transport layer, and the like.

The preferable layer configuration of the electrophotographic photoreceptor of the present invention will now be described.

Sublayer

In order to improve adhesion between the electrically conductive support and said photosensitive layer or to minimize charge injection from said support, provided is the sublayer or u-coat layer (UCL) employed on the photoreceptor of the present invention between said support and said photosensitive layer. Listed as materials of said sublayer are polyamide resins, vinyl chloride resins, vinyl acetate resins, and copolymer resins comprising at least two repeating units of these resins. Of these subbing resins, polyamide resins are preferable as the resins which are capable after repeated use of minimizing an increase in residual potential. Further, the thickness of the interlayer comprised of these resins is preferably between 0.01 and 5 μm.

Listed as sublayers, which are most preferably employed, are those comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprising a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transport layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu-Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As other materials, if desired, incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV, from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. In the case of a photoreceptor in which the charge transport layer is employed as the surface layer, polycarbonates, which exhibit high mechanical wear resistance, are preferred and polycarbonates having an average molecular weight of at least 40,000 are preferable. The ratio of binder resins to charge transport materials is preferably between 10 and 200 weight parts per 100 weight parts of the binder resins. Further, the thickness of the charge transport layer is preferably between 10 and 40 $\mu$m.

Surface Layer (Surface Layer Comprising Siloxane Based Resin Possessing Charge Transportability)

Preferred as electrophotographic photoreceptors of the present invention, which exhibit high hardness, as well as minimize the increase in residual potential, are those in which a resinous layer comprising siloxane based resins, having structural units exhibiting charge transportability, is used as the surface layer. Said siloxane based resinous layer is formed by applying, onto a support, a coating composition prepared by employing organic silicon compounds represented by General Formula (1), described below, as the raw materials and subsequently drying said coated layer. These raw materials undergo hydrolysis in a hydrophilic solvent and subsequently result in a condensation reaction. Thus, they form condensation products (oligomers) of organic silicon compounds in a solvent. By applying these coating compositions onto a support and subsequently drying the resultant coated layer, it is possible to form a resinous layer comprising siloxane based resins forming a three-dimensional net structure.

General Formula (1)

$$(R)_n—Si—(X)_{4-n}$$

wherein R represents an organic group in which a carbon atom directly bonds to a silicon atom, X represents a hydroxyl group or a hydrolyzable group, and n represent an integer of 0 to 3.

In organic silicon compounds represented by General Formula (1), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β (aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolizable groups represented by X are an alkoxy group such as methoxy, ethoxy, and the like, a halogen atom, and an acyloxy group. Specifically preferred are alkoxy groups having not more than 6 carbon atoms.

Further, organic silicon compounds represented by General Formula (1) may be employed individually or in combinations of two or more types. However, it is preferable to employ at least one type of organic silicon compounds represented by General Formula (1), in which n is 0 or 1.

Further, in the specific organic silicon compounds represented by General Formula (1), when n is at least 2, a plurality of R may be the same or different. In the same manner, when n is not more than 2, a plurality of X may be the same or different. Still further, when at least two types of organic silicon compounds represented by General Formula (1) are employed, R and X, in each compound, may be the same or different.

Said resinous layer is preferably formed so that colloidal silica is incorporated into the composition comprising said organic silicon compounds or hydrolyzed condensation products thereof. The colloidal silica, as described herein, means silicon dioxide particles which are dispersed colloidally into a dispersion medium. Said colloidal silica may be added during any stage of preparation of the coating composition. Said colloidal silica may be added in the form of water based or alcohol based sol, and aerosol prepared in a gas phase may be dispersed directly into the coating composition.

In addition, metal oxides such as titania, alumina, and the like, may be added in the form of sol or a particle dispersion.

Colloidal silica and said tetrafunctional (n=0) or trifunctional (n=1) organic silicon compounds provide elasticity as well as rigidity with the resinous layer of the present invention through the formation of a bridge structure. As the ratio of bifunctional silicon compounds (n=2) increases, rubber elasticity as well as hydrophobicity increases. Unifunctional silicon compounds (n=3) undergo no polymerization but increase hydrophobicity upon reacting with residual SiOH groups which have not undergone reaction.

In order to prepare the surface layer of the present invention, which is required to exhibit high hardness as well as high elasticity, at least one type of said tetrafunctional (n=0) or trifunctional (n=1) organic silicon compounds is preferably employed as the raw material so as to from a siloxane based resinous layer provided with the desired elasticity as well as the desired rigidity.

It is possible to minimize an increase in the residual potential of said resinous layer, which is comprised of siloxane based resins having structural units having charge transportability which are prepared utilizing condensation reaction of said organic silicon compounds or condensation products thereof with the compounds represented by General Formula (2) described below.

General Formula (2)

$$B—(R_1—ZH)_m$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

Further, compounds represented by the aforementioned General Formula (2) may be subjected to condensation reaction with the hydroxyl group on the colloidal silica surface and incorporated into said siloxane based resinous layer.

In the present invention, employed may be a composite siloxane based resinous layer prepared by adding other metal hydroxides (for example, hydrolyzed products of each alkoxide of aluminum, titanium, and zirconium) except for said colloidal silica.

B of General Formula (2) is a univalent group comprising a charge transportable compound structure. Comprising a charge transportable compound structure, as described herein, means that the compound structure obtained by excluding a $R_1$—ZH group in General Formula (2) possesses charge transportability or a compound represented by BH, which is obtained by substituting $R_1$—ZH in the aforementioned General Formula (2) with a hydrogen atom, possesses charge transportability.

In other definition, the charge transportable structural unit is a chemical structural unit or a residue of charge transportable compound by which an electric current caused by charge transportation can be detected by a known method for detecting the charge transportation ability such as Time-Of-Flight method.

The composition ratio of the total weight (H) of the condensation product formed from said organic silicon compound, having a hydroxyl group or hydrolyzable group, and an organic silicon compound, having a hydroxyl group or a hydrolyzable group, to the composition of compound (I) represented by the aforementioned General Formula (2) is preferably between 100:3 and 50:100 in terms of the weight ratio, and is more preferably between 100:10 and 50:100.

In the present invention, further, colloidal silica or other metal oxides may be added. When colloidal silica or other metal oxides (J) are added, 1 to 30 weight parts of (J) is preferably employed with respect to 100 parts of said total weight (H) plus the weight of compound (I) component.

When a component, having said total weight (H), is employed within said range, the surface layer of the photoreceptor of the present invention exhibits high hardness as well as sufficient elasticity.

When said siloxane based resinous layer is formed, in order to enhance condensation reaction, condensation catalysts are preferably employed. The condensation catalysts employed herein may be those which either catalytically act on condensation reaction or move the reaction equilibrium of the condensation reaction in the reaction proceeding direction.

Employed as specific condensation catalysts may be those known in the art such as acids, metal oxides, metal salts, alkyl aminosilane compounds, and the like, which have conventionally been employed in silicone hard coat materials. For example, listed may be alkali metal salts of organic carboxylic acids, nitrous acid, sulfurous acid, aluminic acid, carbonic acid, and thiocyanic acid; organic amine salts (tetramethylammonium hydroxide, tetramethylammonium acetate), tin organic acid salts (stannous octoate, dibutyl tin acetate, dibutyl tin dilaurate, dibutyl tin mercaptide, dibutyl tin thiocarboxylate, dibutyl tin maliate, and the like; and the like.

In General Formula (2), the group having the charge transportable compound structure represented by B, has two types, that is, a positive hole transport type and an electron transport type. Listed as positive hole transport type groups are groups having structural units such as oxazole, oxadiazole, thiazole, triazole, imidazole, imidazolone, imidazolone, bisimidazoline, styryl, hydrazone, benzidine, pyrazoline, triarylamine, oxazolone, benzothiazole, benzimidazole, quinazoline, benzofuran, acridine, phenazine, and the like, and groups derived from derivatives thereof. On the other hand, listed as electron transport type groups having structural units such as succinic anhydride, maleic anhydride, phthalic anhydride, pyromellitic anhydride, mellitic anhydride, tetracyanoethylene, tetracyanooxodimethane, nitrobenzene, dinitrobenzene, trinitrobenzene, tetranitrobenzene, nitrobenzonitrile, picryl chloride, quinonechloroimide, chrolanyl, bromanyl, benzoquinone, napthoquinone, diphenoquinone, tropoquinone, anthraquinone, 1-chloroanthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorenone, 2,4,7-trinitrofluorenone, 2,4,5,7-tetranitrofluorenone, 9-fluoronylidenedicyanomethylenemalonitrile, polynitro-9-fluoronylidenedicyanomethylenemalonitrile, picric acid, o-nitro-benzoic acid, 2,5-dinitrobenzoic acid, perfluorobenzoic acid, 5-nitrosalicylic acid, 3,5-dinitrosalycilic acid, phthalic acid, mellitic acid, and groups derived from derivatives thereof. However, the present invention is not limited to these structures.

Representative examples of compounds represented by General Formula (2) are described below.

Examples of compounds, in which Z represents an oxygen atom in General Formula (2), are listed below.

(B-1)

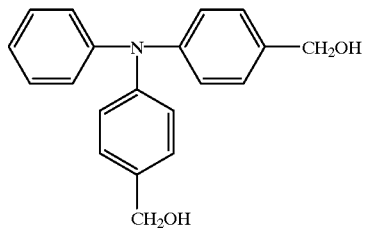

(B-2)

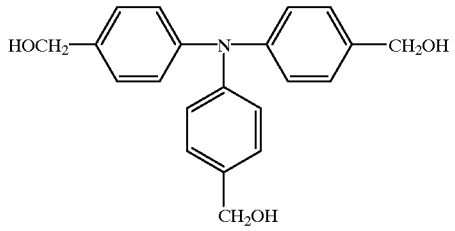

-continued
(B-3)
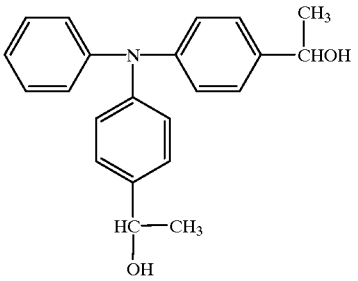
(B-4)
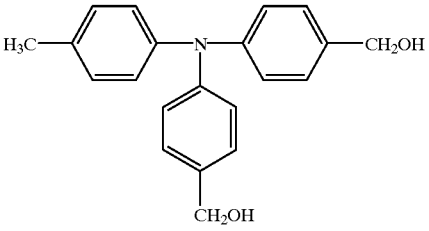
(B-5)
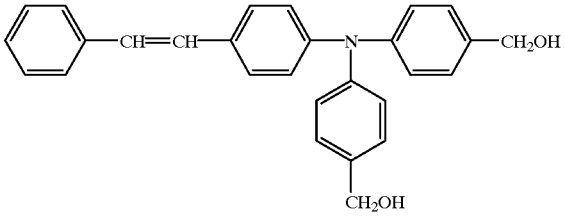
(B-6)
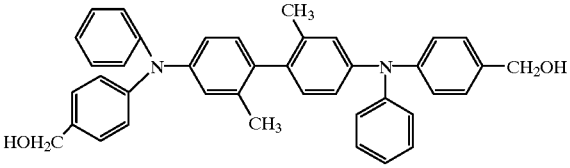
(B-7)
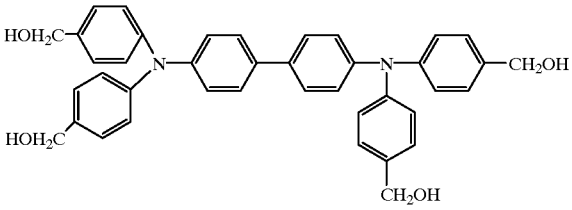
(B-8)
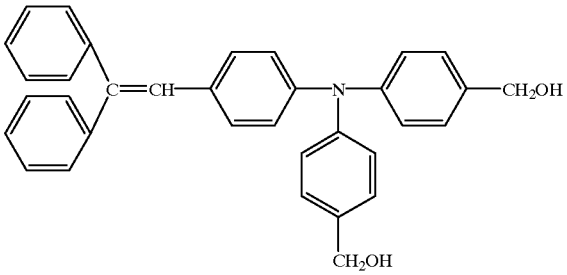
-continued
(B-9)
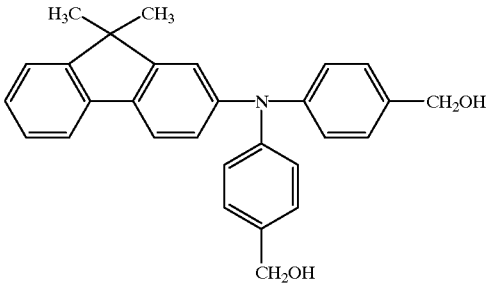
(B-10)
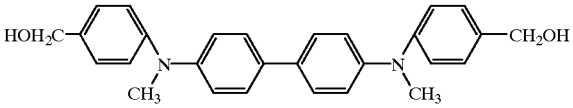
(B-11)
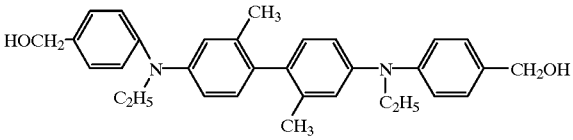
(B-12)
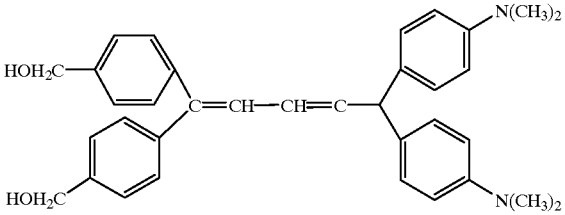
(B-13)
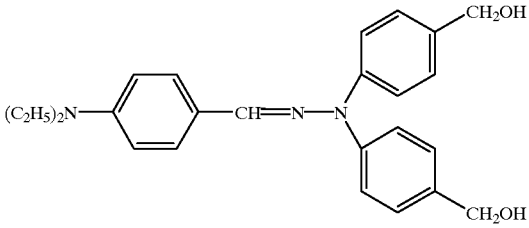
(B-14)
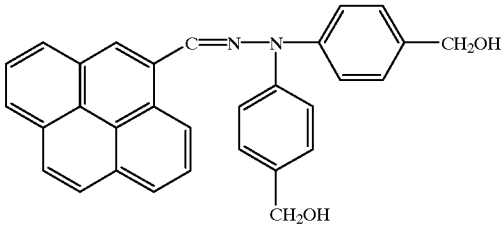
(B-15)
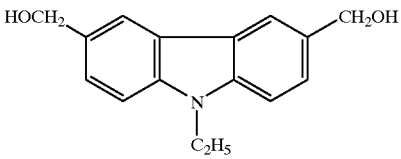

-continued
(B-16)
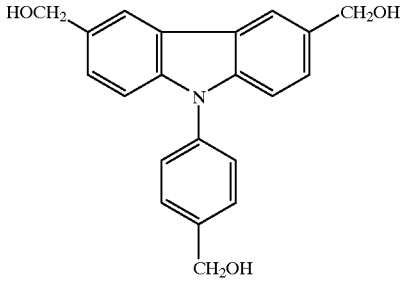
(B-17)
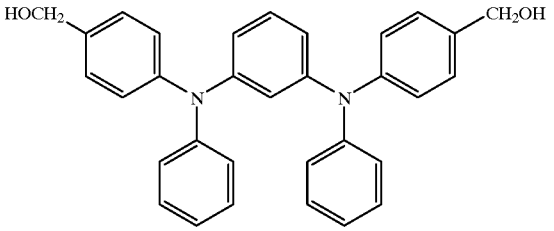
(B-18)
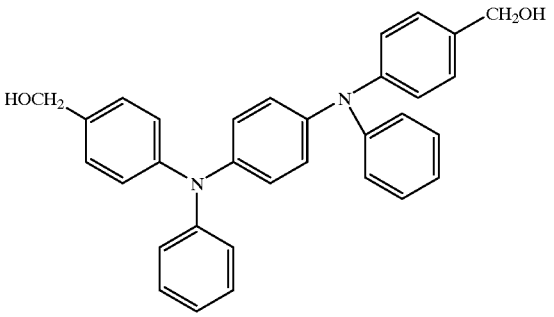
(B-19)
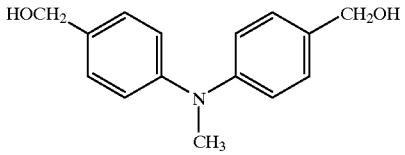
(B-20)
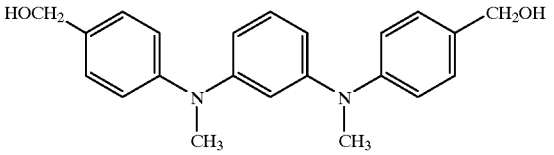
(B-21)
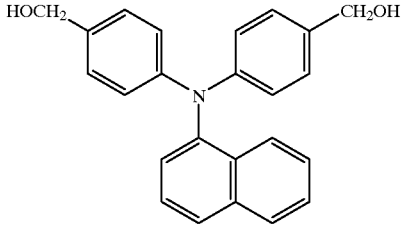
-continued
(B-22)
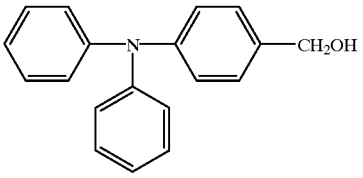
(B-23)
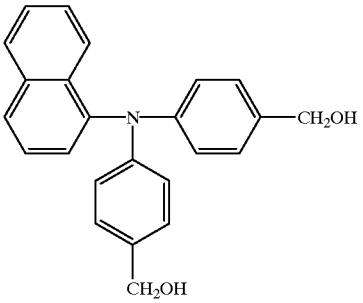
(B-24)
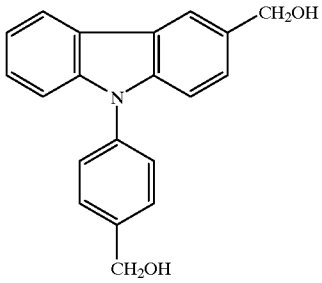
(B-25)
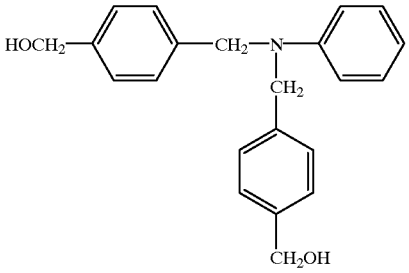
(B-26)
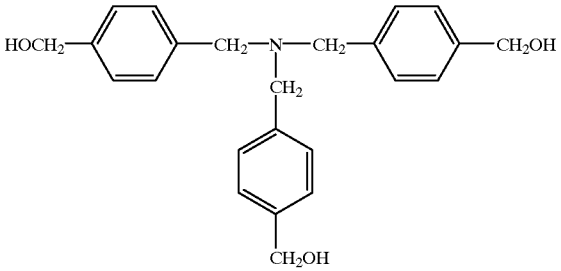
Next, examples of compounds, in which Z represents an NH group in General Formula (2), are listed below.

W-1
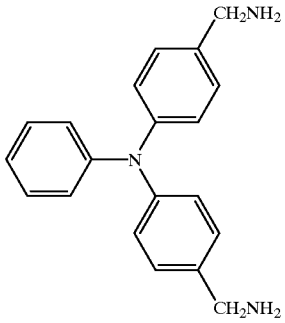
W-2
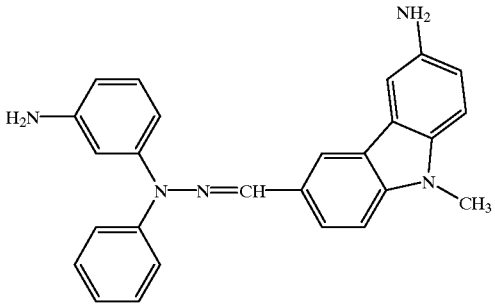
W-3
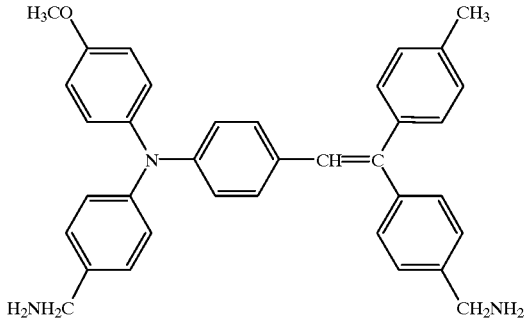
W-4
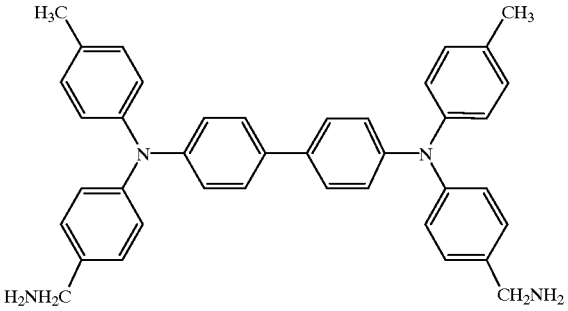
-continued
W-5
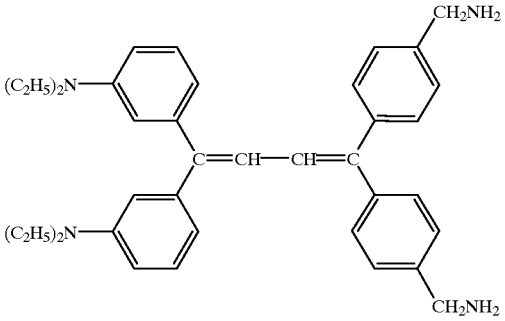
W-6
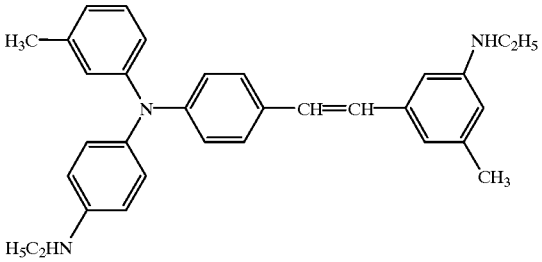
Next, examples of compounds, in which Z represents an mercapto group (SH) in General Formula (2), are listed below.
V-1
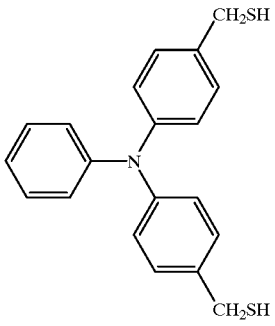
V-2
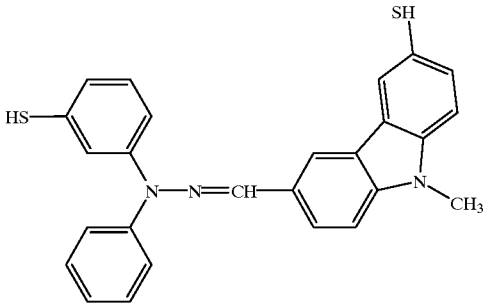

-continued

V-3

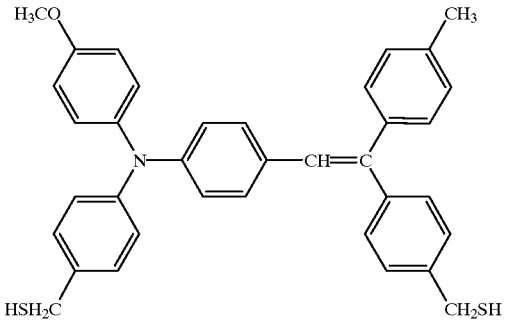

V-4

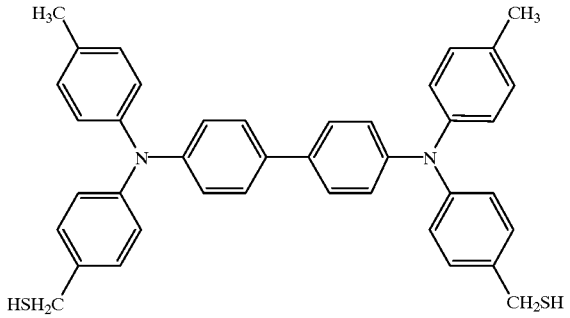

V-5

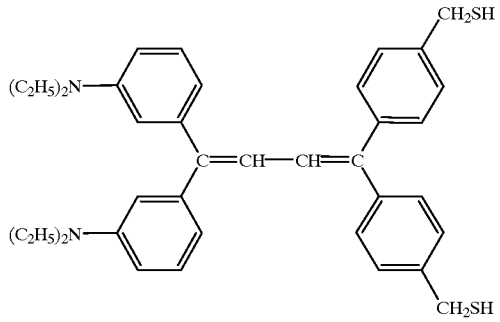

The most preferable compounds, among those represented by General Formula (2) described below, are compounds in which Z represents a hydroxyl group (OH), and m is at least 2. Said compounds, in which Z represents a hydroxyl group (OH) and m is at least 2, react with said organic silicon compounds. As a result, said compounds enter into the net structure of the siloxane based resin so that a resinous layer can be formed which exhibits high hardness as well as minimizes the increase in the residual potential.

The most preferable layer configuration of the present invention is described above. However, in the present invention, the layer configuration, which is different from that described above, may be employed. For example, when a resinous layer, which comprises the siloxane based resin, having structural units possessing charge transportability, is applied to a charge transport layer, the surface layer in the layer configuration of a photoreceptor may be eliminated. Further, when a resinous layer, which comprises the siloxane based resin having structural units possessing charge transportability, is applied to the photosensitive layer having a single layer configuration, it is possible to form on a cylindrical electrically conductive support the electrophotographic photoreceptor of the present invention, employing two resinous layers consisting of a sublayer and a photosensitive layer having a single layer configuration.

Further, the surface layer of the electrophotographic photoreceptor of the present invention preferably exhibits a contact angle between the surface of the photoreceptor and water of at least 90 degrees. By allowing said surface to exhibit a contact angle between the surface of the photoreceptor and water of at least 90 degrees, it is possible to further decrease filming of paper dust as well as of fine toner powder.

As a method to allow said siloxane based resinous layer, possessing charge transportability, to exhibit a contact angle between the surface of the photoreceptor and water of at least 90 degrees, it is effective to increase the hydrophobicity of said siloxane resinous layer. In order to achieve the foregoing, listed are methods in which F atom containing groups are introduced into said siloxane resin, a dimethyl siloxane skeleton is introduced, aromatic groups are introduced, and resinous particles or organic polymers such as PTFE having water resistance are added.

Further, it is possible to effectively minimize the increase in residual potential as well as image blurring by adding antioxidants to the surface layer of said siloxane based resin.

The antioxidants, as described herein, means materials, as representative ones, which minimize or retard the action of oxygen under conditions of light, heat, discharging, and the like, with respect to auto-oxidation occurring materials which exist in the electrophotographic photoreceptor or the surface thereof. Specifically, a group of such compounds described below is listed.

(1) Radical Chain Inhibitors

Phenol based antioxidants (hindered phenol based)

Amine based antioxidants (hindered amine based, diallyldiamine based, diallylamine based)

Hydroquinone based antioxidants (hindered phenol based)

(2) Peroxide Decomposing Agents

Sulfur based antioxidants (thioethers)

Phosphoric acid based antioxidants (phosphorous acid esters)

Of said antioxidants, preferred are radical chain inhibitors included in (1). Specifically hindered phenol based or hindered amine base antioxidants are preferable. Further two or more types may be employed in combinations. For example, hindered phenol based antioxidants listed in (1) are preferably employed together with thioether antioxidants listed in (2). Further, antioxidants may be employed in which structural units of said antioxidants such as hindered phenol structural units and hindered amine structural units are incorporated into molecules.

Of said antioxidants, hindered phenol based and hindered amine based antioxidants are specifically effective for minimizing the formation of background stain as well as image blurring under high temperature and high humidity.

The content of hindered phenol based or hindered amine based antioxidants in a resinous layer is preferably between 0.01 to 20 percent by weight. When the content is less than 0.01 weight percent, neither background stain nor image blurring is minimized under high temperature and high humidity. On the other hand, when the content is no less than 20 percent by weight, charge transportability on the resinous layer is degraded, the residual potential tends to increase, and further, the layer strength decreases.

Further, if desired, said antioxidants may be incorporated into a charge generating layer in the lower layer, a charge transport layer, an interlayer, or the like. The added amount of said antioxidants to these layers is preferably between 0.01 and 20 percent by weight with respect to each layer.

The hindered phenols as described herein means compounds having a branched alkyl group in the ortho position relative to the hydroxyl group of a phenol compound and derivatives thereof. (However, the hydroxyl group may be modified to an alkoxy group.)

The hindered amines are compounds having an organic bulky group neighboring to nitrogen atom. An example of the bulky group is branched alkyl group, preferable example of which is t-butyl group. The preferable examples of the compounds having organic group are those represented by the following structural formula:

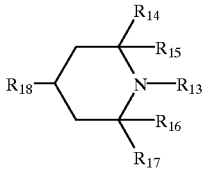

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group.

Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Phosphoric acid compounds include, for example, compounds represented by General Formula RO—P(OR)—OR. Listed as representative compounds are those described below. Incidentally, in said General Formula, R represents a hydrogen atom, and a substituted or unsubstituted group of any of an alkyl group, an alkenyl group or an aryl group.

Organic sulfur compounds include, for example, compounds represented by General Formula R—S—R. Listed as representative compounds are those described below. Incidentally, in the general formula, R represents a hydrogen atom, and a substituted or unsubstituted group of any of an alkyl group, an alkenyl group or an aryl group.

Compound examples of representative antioxidants are listed below.

1-1

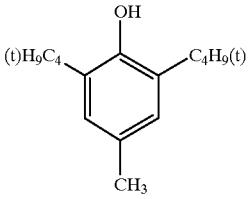

1-2

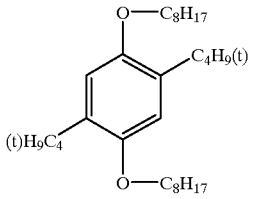

1-3

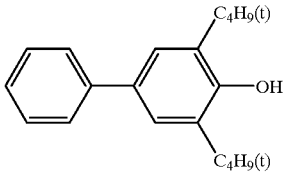

1-4

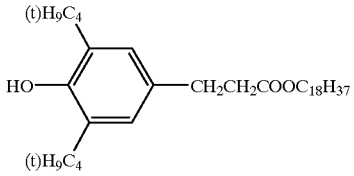

1-5

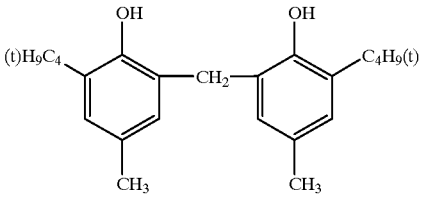

3-1

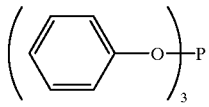

3-2

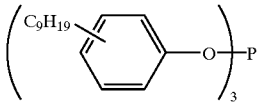

3-3

$(C_2H_5O)_3P$ 3-4

$(C_8H_{17}O)_3P$ 3-5

$(C_{10}H_{21}O)_3P$ 3-6

$(C_{13}H_{27}O)_3P$ 3-7

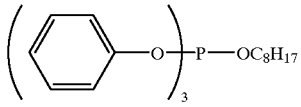

-continued
3-8
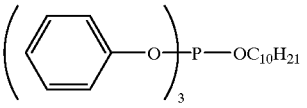
3-9
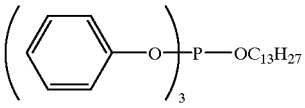
3-10
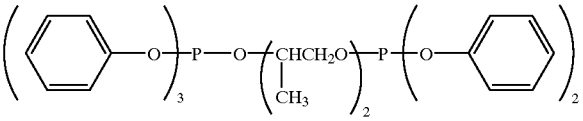
3-11
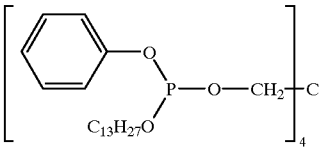
3-12
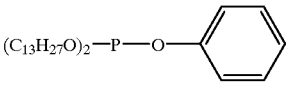
2-1
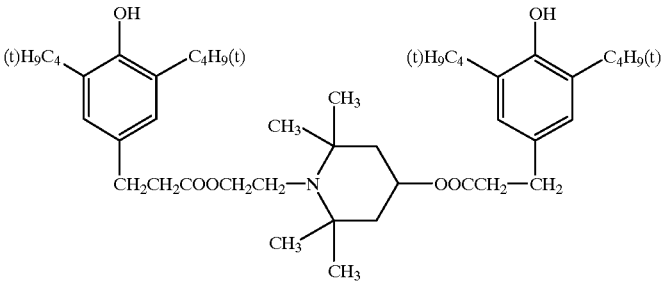
2-2
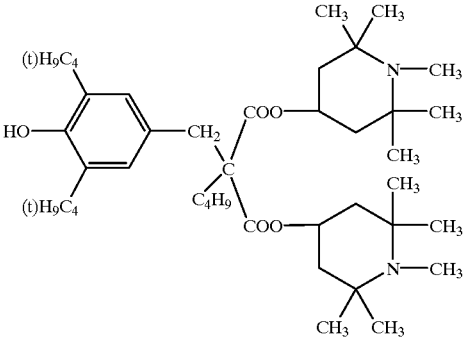
2-3
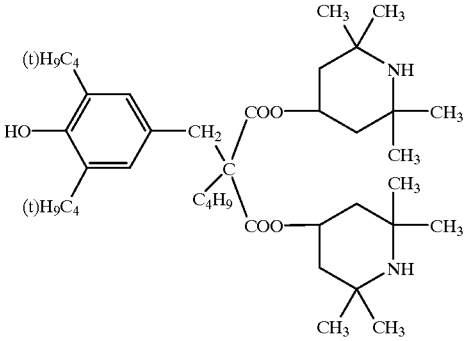
2-4
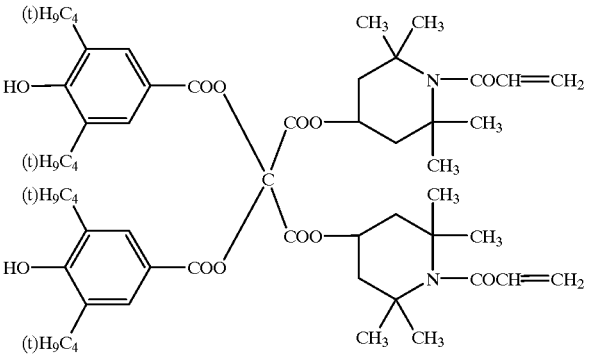

-continued 2-5

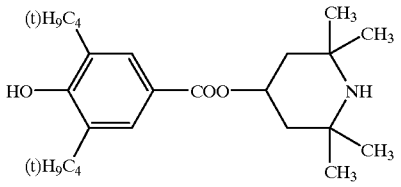

2-6

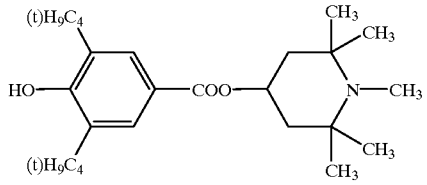

2-7

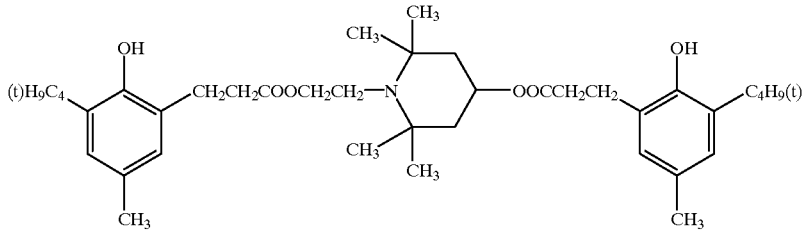

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The siloxane based resin containing layer of the present invention is formed by dissolving siloxane based resinous composition in common solvents and coating the resultant composition onto a support. Employed as said solvents are alcohols and derivatives thereof such as methanol, ethanol, propanol, butanol, methyl cellosolve, ethyl cellosolve, and the like; ketones such as methyl ethyl ketone, acetone, and the like; esters such as ethyl acetate, butyl acetate, and the like; and the like.

The siloxane based resinous layer of the present invention is preferably dried by heating. Cross linking and hardening reaction in said siloxane based resin layer is enhanced by said heating. Said crosslinking and hardening conditions vary depending on the types of solvents used as well as the presence and absence of catalysts, but heating in the range of about 60 to about 160° C. is preferably carried out over 10 minutes to 5 hours, and heating in the range of 90 to 120° C. is more preferably carried out over 30 minutes to 2 hours.

Solvents, which are employed to disperse or dissolve charge generating materials as well as charge transport materials, include hydrocarbons such as toluene, xylene, and the like; halogenated hydrocarbons such as methylene chloride, 1,2-dichloroethane, and the like; ketones such as methyl ethyl ketone, cyclohexanone, and the like; esters such as ethyl acetate, butyl acetate, and the like; alcohols and derivatives thereof such as methanol, ethanol, methyl cellosolve, ethyl cellosolve, and the like; ethers such as tetrahydrofuran, 1,4-dioxane, 1,3-dioxolane, and the like; amines such as pyridine, diethylamine, and the like; amides such as N,N-dimethylformamide, and the like; fatty acids and phenols; sulfur and phosphorous compounds such as carbon disulfide, trimethyl phosphate, and the like; and the like. These may be employed individually or in combination.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open-to Public Inspection Nos. 3-90250 and 3-269238, while the above-mentioned circular amount control type coating is detailed in, for example, Japanese Patent Publication Open to Public Inspection No. 58-189061.

The image forming method employed in the present invention comprises at least each process of charging, image exposure, development, transfer, and cleaning while utilizing a blade. However, the image forming method of the present invention may include other image forming processes than said processes and the present invention may be applied to the image forming method comprising said processes which are improved.

Preferable image forming processes, which are disposed at the periphery of the cylindrical photoreceptor of the present invention, will be successively described.

Subsequently, the image forming method, which is applied to the electrophotographic photoreceptor of the present invention, will be described with reference to one example.

Precharging exposure process (exposure to eliminate the residual charge on the photoreceptor just prior to image formation): In the precharging exposure process, light irradiation is carried out employing LED, and the like. The precharging exposure retards an increase in the residual potential due to delayed response of the photoreceptor, as well as retards the memory generation due to the exposure pattern. However, the electrophotographic photoreceptor of the present invention is capable of producing consistent images over an extended period of time, in the system having no precharging exposure.

Charging process: Either a corona charging system or a contact charging system may suitably be employed. Specifically, since in the contact charging system, the charging member is brought into direct contact with the electrophotographic photoreceptor, which tends to be damaged, the effects of the photoreceptor of the present invention exhibit pronounced effects. Charge potential onto the photoreceptor is suitably determined depending on the employed photoreceptor. Thus, the photoreceptor is charged during the charging process to obtain the charged voltage of 300 to 1,500 V.

Image exposure process: Suitably employed as exposure light sources may be any of white light, LED, and LD. When an exposure amount becomes excessive, the residual potential tends to increase and pronounced effects of the photoreceptor of the present invention are exhibited. In the case of digital images, LED, as well as LD, is preferably employed as the image exposure light source.

Development process: Either single component or double component developer material can be employed for the development process, while either magnetic or non-magnetic toner may be suitably employed. Specifically, since the single component toner exhibits a large abrasive force, the pronounced effects of the electrophotographic photoreceptor of the present invention are exhibited.

Transfer process: Any transfer system employing a corona transfer, a roller transfer, and an intermediate transfer material is suitably employed in the transfer process. Since in the corona transfer, paper dust tends to be electrostatically adhered, the marked effects of the photoreceptor of the present invention are exhibited.

Separation process: Since an electrophotographic photoreceptor formed on a cylindrical support having a very large diameter specifically exhibits inferior separation properties, claw separation is effectively employed. However, when such a claw separation system is utilized, said electrophotographic photoreceptor is susceptible to effects of claw abrasion due to the contact of the separation claw. Therefore, the electrophotographic photoreceptor of the present invention exhibits highly desirable effects in the claw separation process.

Transfer process: Transfer systems employing either corona transfer or an intermediate transfer body may be suitably applied to the transfer process. Since said corona transfer tends to result in electrostatic adhesion of paper dust, the image forming method of the present invention, which minimizes the variation of the residual potential, exhibits highly desired effects.

Cleaning process: Common cleaning blades are suitably employed. Further, employed as auxiliary members for cleaning may be fur brushes and rollers. Since cleaning conditions largely affect the wear of a photoreceptor, use of the electrophotographic photoreceptor of the present invention allows for widely adaptable cleaning processes.

Fixing process: Thermal fixing is preferred, employing, for example, heated roller fixing, flash fixing, and the like.

The image forming method, to which the photoreceptor of the present invention is applied, is basically applied to the image forming processes described above, and further applied to applied or developed processes.

For example, the photoreceptor of the present invention may be applied to a color image forming method in which for color development, a plurality of charging units and development units are disposed around the photoreceptor.

Further, as for the transfer process, application is carried out for a process which utilizes an intermediate transfer body.

The cleaning process may be added with auxiliary cleaning mechanism as well as a process exhibiting a paper dust removing function.

A cleaning process, as well as the developer material, will be described which significantly relate to the effects of the present invention, especially for a decrease in the layer thickness of the photoreceptor, filming, and the like, among said image forming processes.

<<Properties of the Cleaning Blade and Contact Conditions>>

The cleaning means employed in the present invention is one which is provided with a blade-shaped cleaning member which is arranged to be in pressure contract with the photoreceptor. By employing said cleaning blade, the residual toner on the photoreceptor, which has not been transferred, is removed. From the viewpoint of improvement of cleaning properties, said cleaning blade is preferably brought into contact with the photoreceptor under conditions of a pressure contact force P' of 5 to 50 g/cm in terms of linear pressure. When said pressure contact force P' is less than 5 g/cm, the toner tends not to be completely removed, while when said pressure contact force P' is no less than 50 g/cm, blade curl tends to result. Pressure contact methods include a method in which a pressure contact position is previously determined and the blade is then stationarily fixed, a method in which load is adjusted employing a weight, a method employing a spring, and the like. Of these, in order to minimize the fluctuation of the pressure contact force, the weight load method is preferred.

Incidentally, during a pre-stage of the cleaning process, in order to facilitate cleaning, a charge eliminating process, which eliminates charges on the photoreceptor surface, is preferably added. Said charge eliminating process is carried out employing, for example, a charge eliminator which results in alternative current corona discharge.

The cleaning blade employed in the present invention is preferably comprised of elastic rubber materials having a hardness of 65° to 75° and an impact resilience of 15 to 60 percent (at 20° C. and 50±5 percent RH). When the impact resilience is less than 15 percent, the bounding of said blade tends to occur and at an ambience of relatively low temperature, it is difficult to maintain desired cleaning properties. On the other hand, when the impact resilience exceeds 75 percent, said blade tends to increase in the following properties and blade curl tends to occur (physical property parameters, hardness and impact resilience, of the elastic body rubber blade employed in said cleaning blade are measured employing JIS K6301 Vulcanized Rubber Physical Test Method.).

FIG. 1 (*a*) is a view showing contact conditions of a cleaning blade with a photoreceptor.

In FIG. 1 (*a*), reference numeral 1 is an electrophotographic photoreceptor, and θ is the contact angle of a blade. Further, free length L of said blade 2, as shown in FIG. 1 (*a*), is the length between end B of holder 3 (a blade holder) and the end point of said blade prior to deformation. "h" is the thickness of said blade. Further, blade contact angle θ is the angle between tangential line X and the blade prior to deformation (shown in FIG. 1 (*a*) as a dotted line). Still further, as shown in FIG. 1 (*a*), thrust amount "a" is the difference between radius $r_0$ of the external circumference of a photoreceptor and radius $r_1$ of circle $S_1$, having as the center central axis C of said photoreceptor which is located at position A' of the blade prior to its deformation (shown in FIG. 1 (*a*) as a dotted line).

Linear pressure F of the cleaning blade applied to the photoreceptor of the present invention can be obtained employing the formula described below, which represents a balance between the gravitational force applied to the center of gravity on fulcrum 4 of the holder, and the repulsive force moment with respect to blade pressure.

$$\{[m(\text{weight of the holder+load } m_1)]/L_3 \text{ (total length of the blade)}\}\times L_2 \sin\theta_1 = FL1 \cos\theta_0$$

wherein F is the linear pressure.

In order to illustrate the above formula, in FIG. 1 (*b*), the relationship between the blade and the photoreceptor is shown.

In FIG. 1 (*b*), reference numeral 1 is an electrophotographic photoreceptor, reference numeral 2 is a cleaning blade, reference numeral 3 is a holder (a blade holder), 4 is the fulcrum of said holder, M is the center of gravity of said holder, θ is the contact angle of said blade, $\theta_0$ is the attached angle of said holder, α is the contact angle to said photoreceptor, $L_1$ is the distance between contact point A and fulcrum 4 of said holder, $\theta_1$ is the angle between the line connecting the center of gravity of said holder with fulcrum 4 of said holder and the vertically directed line, A is the contact point of said blade with said photoreceptor, $L_3$ is the length of said blade in the longitudinal direction (the total length), and $m_1$ is the load applied to said cleaning blade.

The cleaning blade employed in the present invention may be made of silicone rubber, urethane rubber, and the like, but a blade made of urethane rubber is most preferable.

Further, when mechanisms such as auxiliary rollers employing a fur brush, expanded urethane, and the like are preferably employed in combination as the auxiliary member, since it is possible not only to decrease the load applied to the cleaning blade but also to minimize the adhesion of foreign materials, such as paper dust, and the like, onto the photoreceptor.

Used are silicone rubber, urethane rubber, and the like, in the cleaning blades employed in the present invention, but those made of urethane rubber are most preferred.

Developer Materials

Next, properties of the toner, which is preferably employed in the present invention, as well as the production method thereof, will be described.

The toner, employed in the present invention, is preferably comprised of colored particles containing resinous binders, colorants, and if desired, other additives, which are externally added as external additive particles.

The toner, which is employed in the present invention, generally has an average particle diameter of 1 to 30 μm in terms of the volume average particle diameter, and preferably has the same of 5 to 15 μm.

Resinous binders which fabricate colored particles are not particularly limited, and various resins, conventionally known in the art, are employed, including, for example, styrene based resins, acryl based resins, styrene/acryl based resins, polyester resins, and the like. Herein, in order to improve the fixability as well as blocking properties, the glass transition temperature of said resins is generally between 45 and 70° C., and is preferably between 52 and 65° C. When said temperature is relatively low, external additive particles adhere well, while when the blocking properties are degraded. On the other hand, said temperature is relatively high, no blocking problem occurs, while the adhesion to paper is degraded resulting in problems of lowered fixability.

Colorants are not particularly limited, and those known in the art may be employed. For instance, suitably employed may be carbon black, nigrosine dyes, and the like.

In the case of a single component toner, employed as colorants may be magnetic particles such as magnetite, and the like.

Listed as other additives are, for example, charge control agents such as salicylic acid derivatives, azo based metal complexes, and the like; fixability improvers such as low molecular weight polyolefin, carnauba wax, and the like; and the like.

Toner in the developer material, which is employed in the development process of the present invention, is preferably blended with powder having a number average particle diameter of 10 to 300 nm, as an external additive. The number average particle diameter of said external additives, as described herein, means the value obtained in such a manner that 100 randomly selected particles are observed as the primary particles, employing a transmission type electron microscope, under a magnification factor of 2,000, and are subjected to image analysis.

The external additives of the present invention, as described herein, means fine powder which is added to the toner itself for the purpose of improving its performance, which is not achieved by the toner itself, such as, for example, chargeability, fluidity, transferring properties, cleaning properties, upon externally adding, to toner itself, fine powder having a particle diameter less than that of the toner particles. Specifically listed as such external additives are inorganic particles such as hydrophobic silica, titania, and the like; organic particles, fatty acid metal salts such as zinc stearate and the like; and the like.

Listed as external additives, which are employed in the present invention, are two main groups, being inorganic particles and organic particles. Said particles, having a number average particle diameter of 10 to 300 nm, are preferably employed. When the number average particle diameter of said external additives is greater than 300 nm, said external additives tend to separate from the toner particles. For that reason, filming on a photoreceptor tends to occur. When the number average particle diameter is less than 10 nm, effects of said external additives such as the fluidity improving agent are degraded, tending to result in insufficient cleaning.

Further, a more preferred toner is one which has externally added particles having a number average primary particle diameter of 10 to 49 nm, as well as particles having a primary particle diameter of 50 to 300 nm in an amount of 0.1 to 3.0 percent by weight with respect to said colored particles, and the resultant toner exhibits pronounced effects to achieve the purposes of the present invention.

Suitably employed as said inorganic particles are various inorganic oxides, nitrides, borides, and the like. Examples include silica, alumina, titania, zirconia, barium titanate, aluminum titanate, strontium titanate, magnesium titanate, cerium oxide, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride, and the like.

Further, said inorganic particles may be subjected to hydrophobic treatment. Said hydrophobic treatment is preferably carried out employing various so-called coupling agents, such as silane coupling agents, and the like. Still further, inorganic particles, which are subjected to hydrophobic treatment employing higher fatty acid metal salts such as aluminum stearate, zinc stearate, calcium stearate, and the like, are also preferably employed.

On the other hand, compositions of organic particles are not particularly limited. Generally, vinyl based organic particles are preferred. The reason is that they are readily prepared employing production methods such as an emulsion polymerization method, a suspension polymerization method, and the like. Specifically listed as materials which fabricate organic particles are styrenes and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-t-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, dimethyl aminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethyl hexyl acrylate, stearyl acrylate, lauryl acrylate, phenyl acrylate, dimethyl aminoethyl acrylate, diethyl aminoethyl acrylate, and the like; and the like. These may be employed individually or in combination.

Further, materials to fabricate other vinyl based resinous particle include olefins such as ethylene, propylene, isobutylene, and the like; halogen based vinyls such as vinyl chloride, vinylidene chloride, vinyl bromide, vinyl fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; and acrylic acid or methacrylic acid derivatives such as acrylonitrile, acrylamide, N-butylmethacrylamide, N,N-dibutylacrylamide, methacrylamide, N-butylmethacrylamide, N-octadecylacrylamide, and the like. These vinyl based monomers may be employed individually or in combination.

Further, it is necessary that resinous particles be stable, when the developer material is employed over an extended period of time. Accordingly, said resinous particles are preferably employed which undergo cross linking, employing various cross linking agents so as to increase their hardness. Examples of said cross linking agents include divinylbenzene, ethylene glycol diacrylate, diethylene glycol diacrylate, trimethylene glycol diacrylate, ethylene glycol dimethacrylate, diethylene glycol dimethacrylate, triethylene glycol dimethacrylate, and the like. The used amount of cross linking agents is optionally adjusted depending on the desired degree of cross linking, but said amount is preferably between 0.1 and 5 percent by weight with respect to the vinyl based monomer. When the amount of cross linking agents is excessively large, hardness increases, while brittleness increases. Thus problems with a decrease in durability occur. On the other hand, when the amount is excessively small, minimal effects of the cross linking agents will be exhibited.

Said resinous particles may be prepared employing an emulsion polymerization method as well as a suspension polymerization method. The emulsion polymerization method is one in which the aforementioned monomers are added to, and emulsified in water, comprising surface active agents, and then undergo polymerization. Said surface active agents are not particularly limited, and it is possible to employ all surface active agents such as sodium dodecylbenzenesulfonate, polyvinyl alcohol, ethylene oxide addition products, sodium slats of higher alcohols, which are employed as surface active agents. Further, so-called non-emulsion polymerization methods such as described below may be suitably employed; use of reactive emulsifiers, polymerization of hydrophilic polymers such as vinyl acetate, methyl acrylate, and the like employing persulfate salt based initiators, a method of copolymerization of water-soluble monomers, a method of employing water-soluble resins or oligomers, a method of employing decomposable emulsifiers, and a method employing cross linking type emulsifiers, and the like. Listed as reactive emulsifiers are sulfonate salts of acrylic acid amide and salts of maleic acid derivatives. The non-emulsion polymerization method result in no effect of any remaining emulsifiers and is suitable when organic particles are employed as single units.

Listed as polymerization initiators, which are necessary for synthesizing resinous particles, are peroxides such as benzoyl peroxide, lauryl peroxide, and the like, and azo based compounds such as azobisisobutylonitrile, azobisisovarelonitrile, and the like. The added amount of these initiators is preferably between 0.1 and 2.0 percent by weight with respect to the monomers. When said amount is excessively small, insufficient polymerization reaction results to leading to problems of residual initiators. On the other hand, when said amount is excessively large, decomposed polymerization initiators remain to result in adverse effects on chargeability, and further, the polymerization reaction is carried out too rapidly resulting in problems with the low molecular weight. Further, in said emulsion polymerization method and the like, employed as polymerization initiators, may be potassium persulfate, sodium thiosulfate, and the like.

Incidentally, the aforementioned inorganic particles, as well as organic particles, may be employed in combination.

The added amount of said particles is preferably between about 0.1 and about 5.0 percent by weight. When said amount is excessively small, improvement of fluidity is not effected, while when said amount is excessively large, problems tend to occur in which due to the release of added particles, the photoreceptor is subjected to abrasion and conveyance is not well carried out.

In the present invention, external additives are preferably adhered onto the toner particle surface, employing a method in which toner particles and external additives are blended while stirring and said external additives are uniformly adhered onto the toner particle surface under mechanical impact force. Toner particles onto which external additive are adhered, as described in the present invention, means, as described above, toner particles which have been subjected to adhesion treatment of external additives. Specifically available mixing devices include a Henschel mixer, a Redige mixer, a Nauter mixer, a W-cone mixer, a Vibro mill, and the like. Of these, said Henschel mixer is suitably employed because the mixing treatment, as well as adhesion treatment of external additives, is carried out in the same device and also from the viewpoint of ease of mixing as well as stirring, ease of exterior heating, and the like.

Further, mixing conditions during said adhesion treatment are preferably such that said treatment is carried out at a peripheral speed at the end of the stirring blade of 5 to 50 m/second, and said treatment is more preferably carried out at said speed for 10 to 40 m/second. Still further, during said adhesion treatment, if desired, the temperature may be adjusted to the desired value, employing heated water from the exterior.

Two or more types of external additives may be added simultaneously so as to meet purposes.

Toner particles onto which external additives are adhered, as described in the present invention, means, as described above, toner particles which have been subjected to adhesion treatment of external additives.

Further, said inorganic particles and organic particles may be employed in combination.

The added amount of said particles is preferably between 0.1 and 5.0 percent by weight, with respect to the toner. When the added amount is excessively small, the resultant fluidity is not effectively improved, while when the added amount is excessively large, problems may occur, in which due to released added particles, abrasion of the photoreceptor, as well as insufficient conveyance of developer materials, results.

Properties of toner, preferably employed in the present invention, as well as its production method, will now be described.

<<Toner having an Adhesions Ratio Fd of External Additives of 10 to 90 percent>>

Toner of the developer material, which is employed in the development process of the present invention, is preferably blended with powder having a number average particle diameter of 10 to 300 nm as an external additive. Further, the adhesion ratio Fd of the external additives, which is represented by the formula described below, is preferably between 10 and 90 percent.

$$Fd=[1-\{(Sw_1-Sw_2)/SW_3\}]\times 100$$

wherein $Sw_1$ is the BET specific surface area (in $m^2/g$) of the toner onto which external additives are adhered, $Sw_2$ is the BET specific surface area (in $m^2/g$) of the toner prior to the addition of external additives, and $Sw_3$ is the specific BET surface area (in $m^2/g$) of said external additives.

The number average particle diameter of said external additives means the value measured in such a manner that 100 randomly selected particles are observed as the primary particles, employing a transmission type electron microscope under a magnification factor of 2,000, and are subjected to image analysis to obtain the average diameter in the fere direction.

Further, to meet specific purposes, at least two types of external additives may be simultaneously added.

When the toner of the present invention is employed as a double component developer material, said toner, as well as a carrier, is needed. Employed as said carrier are magnetic material particles having a volume average particle diameter of 20 to 200 $\mu$m, and preferably of 30 to 100 $\mu$m. Listed as said magnetic materials are ferrite, magnetite, iron powder, and the like.

Preferably employed as monomers, which fabricate olefin based resins, are aliphatic unsaturated hydrocarbon based monomers such as ethylene, propylene, 1-butene, isobutylene, 1-octane, 1-pentene, 2-methyl-1-butene, 1-hexane, 1-nonene, 1-decene, and the like. Further, it is possible to employ resins or copolymers obtained from other vinyl based monomers. Polyethylene, which is prepared employing ethylene as the monomers, is preferable. Listed as these magnetic materials are ferrite, magnetite, iron powder, and the like.

The surface of the carrier, which is employed in the present invention, is preferably coated with resins which can create a low surface energy layer. A carrier, which is coated, for example, with silicone resins, fluorine resins, or polyolefin resins, is preferable. The coated amount is generally between 1 and 20 percent by weight with respect to the magnetic material particles, and is preferably between 2.5 and 8 percent by weight. When the coated amount is less than 1 percent by weight, the coated layer may not be uniform and thus the excellent properties of the resin-coated carrier may not be exhibited. By contrast, when the coated amount exceeds 20 percent by weight, the layer thickness becomes excessive. As a result, the fluidity of the carrier is degraded and background staining, as well as toner scattering, may result due to an insufficient charge increase.

Employed as methods for producing the carrier, which is employed in the present invention, may be various coating methods which are commonly known, for example, a method in which polyolefin is dissolved in an appropriate solvent and is spray coated onto the surface of magnetic particles, and a method in which polyolefin is adhered onto the surface of magnetic particles and is mechanically fixed while heating resinous materials to higher than the melting point, a surface polymerization coating method described in Japanese Patent Publication Open to Public Inspection No. 60-106808 and others, and the like.

Incidentally, the number average particle diameter of the external additives of the present invention means a value measured in such a manner that 100 randomly selected particles are observed as the primary particles, employing a transmission type electron microscope under a magnification factor of 2,000, and are subjected to image analysis to obtain the average diameter in the fere direction.

Further, used as the volume average particle diameter of the toner of the present invention was the value which was measured employing a Coulter Multisizer (manufactured by Coulter Co.).

Figure 2:
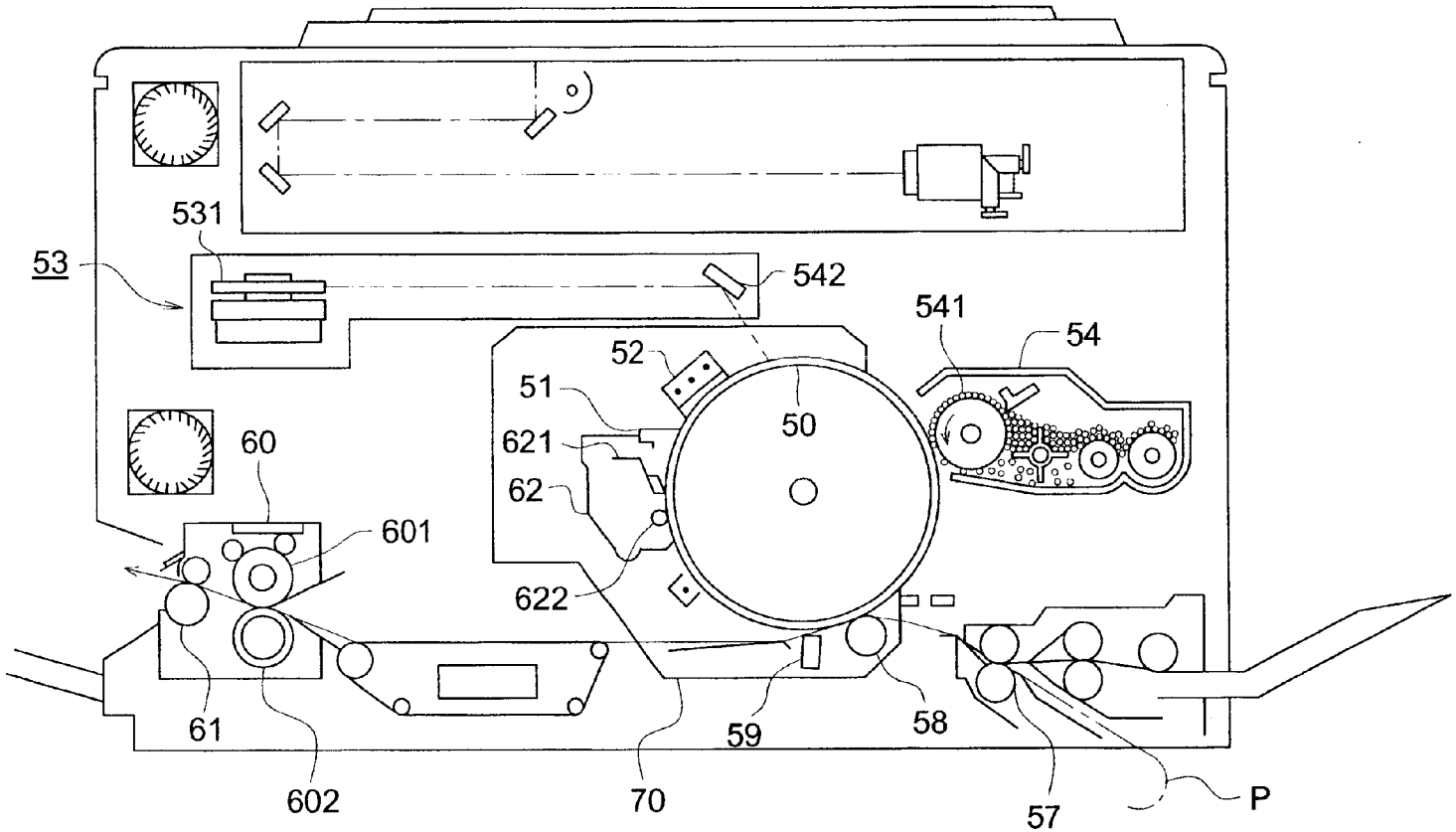
FIG. 2 is a cross-sectional view of an electrophotographic image forming apparatus as one example of the image forming apparatus of the present invention.
Figure 3:
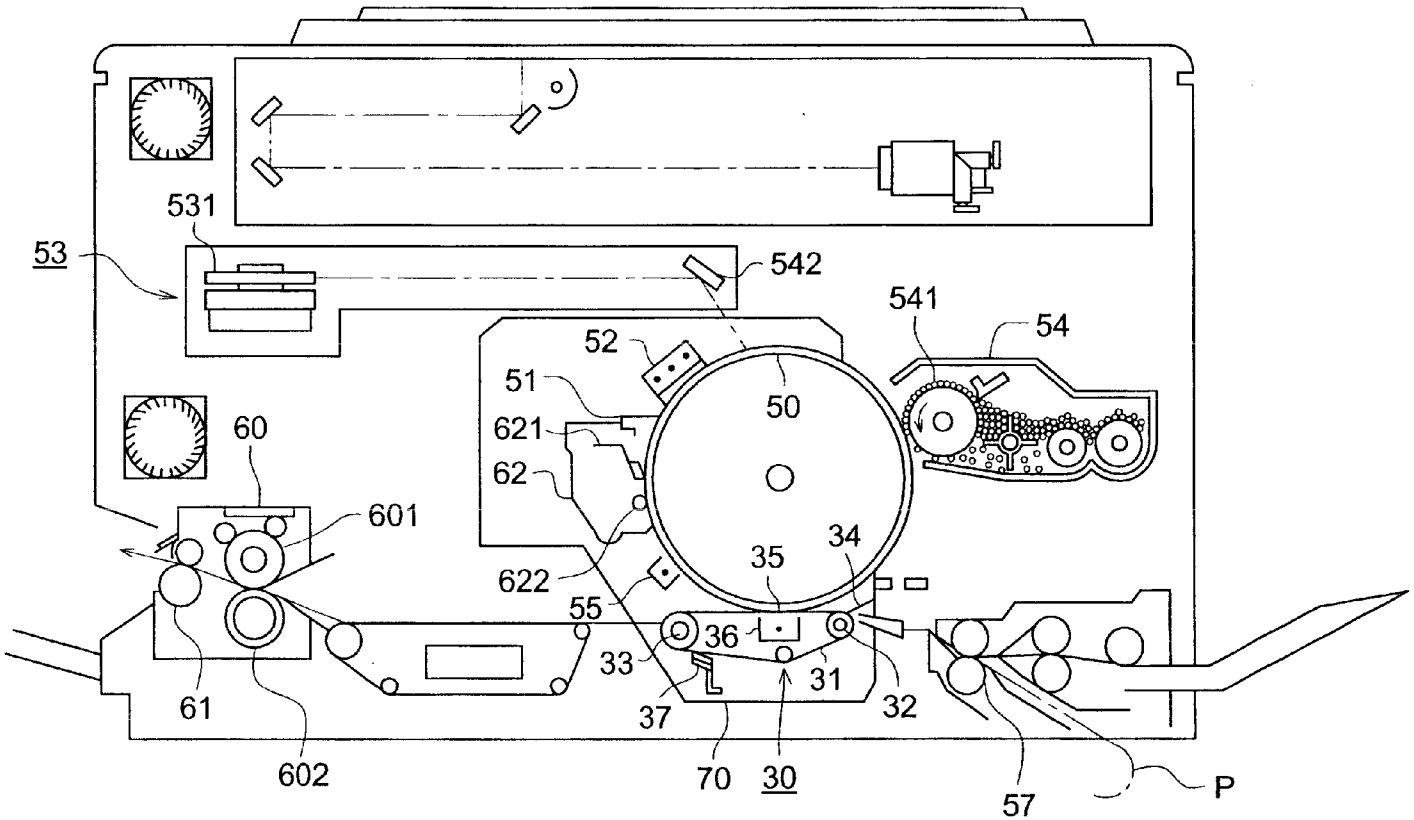
FIG. 3 is a cross-sectional view of an electrophotographic image forming apparatus as another example of the image forming apparatus of the present invention.

FIG. 2 is a cross-sectional view of an electrophotographic image forming apparatus as one example of the image forming apparatus of the present invention.

In FIG. 2, reference numeral 50 is a photoreceptor drum (hereinafter referred to as a photoreceptor) which is an image bearing body. Said photoreceptor is prepared by applying an organic photosensitive layer onto the drum, and further by applying the resinous layer of the present invention onto the resultant layer. It is grounded and rotated clockwise. Reference numeral 52 is a scorotron charging unit which uniformly charges the circumferential surface of photoreceptor drum 50 via corona discharge. Prior to charging, employing said charging unit 52, in order to eliminate the hysteresis of said photoreceptor due to the previous image formation, the photoreceptor surface may be subjected to charge elimination through exposure, employing exposure section 51 comprised of light emitting diodes and the like.

After uniformly charging the photoreceptor, image exposure is carried our based on image signals employing image exposing unit 53. Said image exposing unit, in FIG. 2, comprises a laser diode, not shown, as the exposure light source. Scanning onto the photoreceptor drum is carried out employing light of which light path has been deflected by reflection mirror 542 through rotating polygonal mirror 531, fθ lens, and the like, and thus an electrostatic latent image is formed.

The resultant electrostatic latent image is subsequently developed, employing development unit 54. Around photoreceptor drum 50, development unit 54, which stores the developer material comprised of a carrier and a toner, is provided, and development is carried out employing development sleeve 541, internally comprised of magnets and rotates while bearing the developer material. Said developer material is comprised, for example, of a carrier which is prepared by coating the surface of said ferrite as the core with insulating resins, and a toner which is comprised of said styrene acrylic resins as the main material, colorants such as carbon black and the like, a charge control agent, and colored particles comprised of low molecular weight polyolefin of the present invention, to which titanium oxide and the like is externally added. Said developer material is regulated to form a thickness of 100 to 600 $\mu$m on development sleeve 541, employing a layer forming means, and is conveyed to the development zone, where development is carried out. Said development is carried out in such a manner that direct current bias voltage, and if desired, alternative current bias voltage, are applied to the space between photoreceptor drum 50 and development sleeve 541. Further, development is carried out in the state in which said developer material comes into either contact or non-contact with said photoreceptor.

After forming an image, copy sheet P is conveyed to a transfer zone, when the transfer timing is properly adjusted, by the rotation operation of sheet feeding roller 57.

In the transfer zone, transfer roller (transfer unit) 58 is brought into pressure contact with the circumferential surface of photoreceptor drum 50 in synchronous timing, and transfer is carried out while sandwiching copy sheet P.

Subsequently, copy sheet P is subjected to charge elimination employing separation brush (separation unit) 59 which is allowed to be in a pressure contact state almost simultaneously when said transfer roller is in its contact state. Then copy sheet P is separated from the circumferential surface of photoreceptor drum 50 and conveyed to fixing unit 60. Therein, the toner is melt fixed by heat and pressure of heated roller 601 and press roller 602. Thereafter, copy sheet P is ejected to the exterior of the apparatus via sheet ejecting roller 61. Further, after passing copy sheet P, said transfer roller 58 as well as said separation brush 59 withdraw from the circumferential surface of said photoreceptor drum and are prepared for the formation of a subsequent toner image.

Further, said photoreceptor drum 50, which has been separated from copy sheet P, is subjected to removal of residual toner and the surface cleaning utilizing the pressure contact of cleaning blade 621 of cleaning unit 62. Subsequently, said photoreceptor 50 is subjected to charge elimination employing exposure section 51 and charging employing charging unit 52, and enters into the subsequent image processing process.

Reference numeral 70 is a detachable processing cartridge which is integrally comprised of a photoreceptor, a charging unit, a transfer unit, a separation unit, and a cleaning unit.

An electrophotographic image forming apparatus may be fabricated in such a manner that fabricating elements such as a photoreceptor, a separation unit, a cleaning unit, and the like are integrated as said processing cartridge and said cartridge is removably fabricated with the apparatus main body. Further, a processing cartridge, which is integrally comprised of a photoreceptor together with at least one of a charging unit, an image exposure unit, a development unit, a transfer or separation unit, and cleaning unit, is created. Said cartridge may be detachable from the apparatus main body as a single unit, while employing a guide means such as a rail in the apparatus main body.

Generally, the processing cartridges include an integrated type and a separate type cartridge as shown below. The integrated cartridge, as described herein, refers to one which is integrally comprised of a photoreceptor, together with at least one of the following: a charging unit, an image exposure unit, a development unit, a transfer or separation unit, and cleaning unit, and is detachable from the apparatus main body, while the separation type cartridge, as described herein, refers to a charging unit, an image exposure unit, a development unit a transfer or separation unit, and a cleaning unit which are fabricated separately from a photoreceptor and is detachable from the apparatus main body, and when it is installed in the apparatus main body, it is integrated with a photoreceptor. The processing cartridges in the present invention include both types as described above.

Next, copy sheets are represented by plain paper sheets. However, copy sheets are not particularly limited to such sheets as long as it is possible to transfer unfixed images after development to said sheets, and naturally, PET base sheets for OHP are included.

Image exposure is effected as follows: when an electrophotographic image forming apparatus is used as a copier or printer, reflected light or transmitted light from an original document is exposed onto a photoreceptor, or light is exposed onto a photoreceptor in such a manner that an original document is read employing a sensor, and is converted into signals, and in accordance with the resultant signals, laser beam scanning, driving of an LED array, or driving of a liquid crystal shutter array, is effected.

Incidentally, when employed as a printer of a facsimile machine, image exposure unit 53 carries out exposure to print received data.

The electrophotographic photoreceptor of the present invention can generally be applied to electrophotographic apparatuses such as copiers, laser printers, LED printers, liquid crystal shutter type printers, and the like, and can further be widely applied to apparatuses such as displays, recording media, small volume printing, plate making, facsimile production, and the like, to which common electrophotographic techniques are applied.

Figure 4:
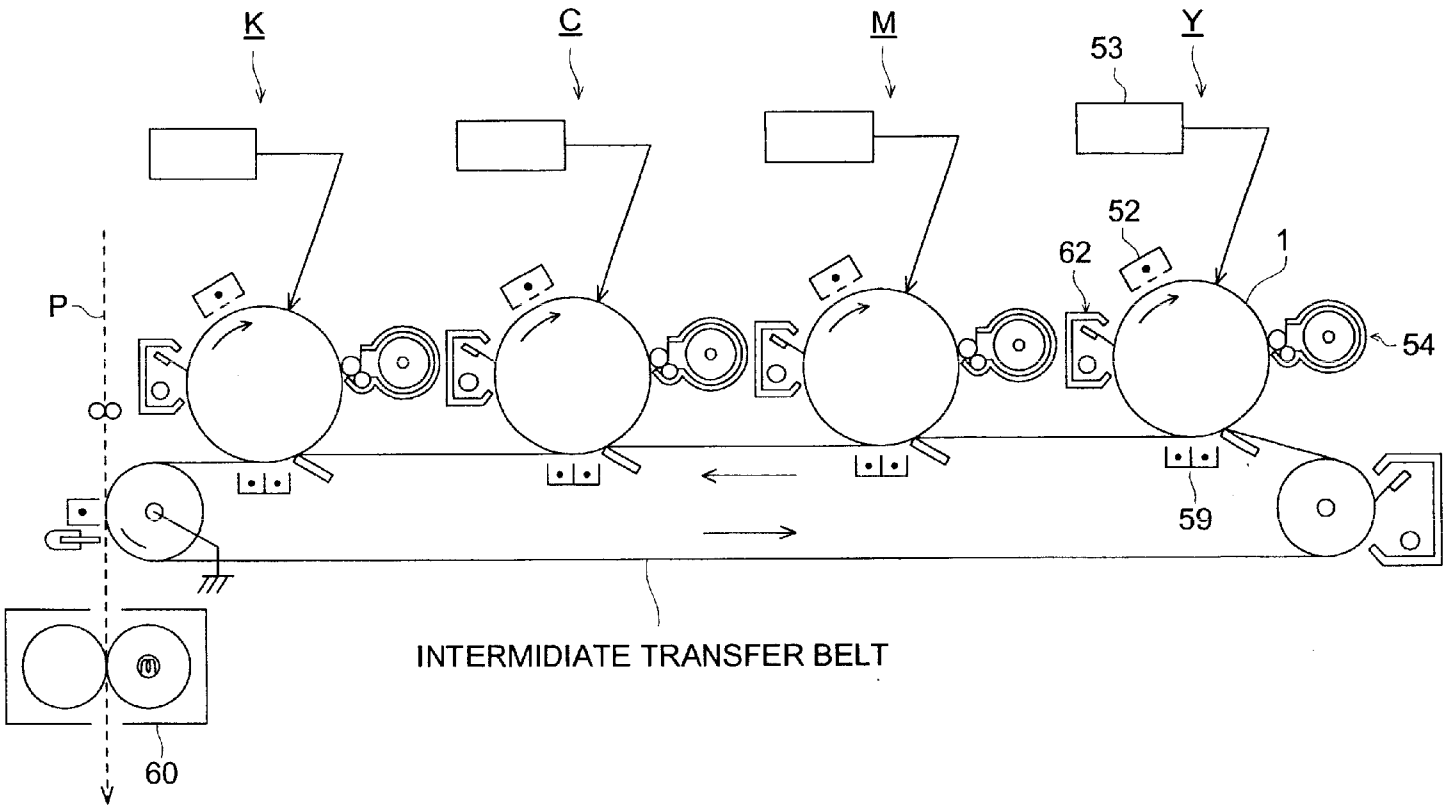
FIG. 4 is a cross-sectional view of color image forming unit employing an intermediate transfer belt.

The invention can be applied to a color image forming apparatus having photoreceptor, exposing, charging and developing parts for each of yellow, magenta, cyan and black color, and intermediate transfer member on which each of color toner image is transferred as shown in FIG. 4. An image forming apparatus having reduced filming can be produced because paper is not brought into contact with the photoreceptor whereby paper powder does not adhere to the photoreceptor in the image forming apparatus employing such an intermediate transfer member.

EXAMPLES

The present invention will now be detailed with reference to examples. However, the embodiments of the present invention are not limited to these examples.

Preparation of Photoreceptor 1-1

•Sublayer

| | |
|---|---|
| Titanium chelate compound (TC-750, manufactured by Matsumoto Seiyaku) | 30 g |

-continued

| •Sublayer | |
|---|---|
| Silane coupling agent (KMB-503, manufactured by Shin-Etsu Kagaku) | 17 g |
| 2-Propanol | 150 ml |

were blended and applied to a ϕ60 mm cylindrical electrically conductive support to obtain a dried layer thickness of 0.5 μm.

| •Charge Generating Layer | |
|---|---|
| Y type titanyl phthalocyanine (having a maximum peak of Bragg angle 27.2 degrees with respect to Cu-α line, and an IP of 5.2 eV) | 60 g |
| Silicone modified butyral resin (X-40-1211, manufactured by Shin-Etsu Kagaku) | 700 g |
| 2-Butanone | 2000 ml |

were blended and dispersed for 10 hours, employing a sand mill to prepare a charge generating layer coating mix. The resultant mix was applied onto said sublayer, employing a dip coating method, and a charge generating layer, having a dried layer thickness of 0.2 μm, was formed.

| •Charge Transport Layer | |
|---|---|
| Charge transport material (N-(4-methylphenyl)-N-[4-{(β-diphenyl)styryl}phenyl]-p-toluidine having an IP of 5.4 eV) | 225 g |
| Polycarbonate (having a viscosity average molecular weight of 30,000) | 300 g |
| Antioxidant (Exemplified Compound 1–32) | 6 g |
| Dichloromethane | 2000 ml |

were blended and dissolved to prepare a charge transport layer coating composition. The resultant coating composition was applied onto said charge generating layer employing a dip coating method, and a charge transport layer having a dried layer thickness of 20 μm was formed. The IP difference between the charge generating material and the charge transport material was 0.2 eV.

| •Resinous Layer | |
|---|---|
| Methyltrimethoxysilane | 182 g |
| Compound (Exemplified Compound B-1) | 40 g |
| Antioxidant (Exemplified Compound 2-1) | 1 g |
| 2-Propanol | 225 g |
| 2 Percent acetic acid | 106 g |
| Aluminum tris-acetyl acetate | 1 g |

were blended to prepare a coating composition for the resinous layer. The resultant coating composition was applied onto said charge transport layer employing a circular amount-regulating type coating apparatus to form a resinous layer having a dried layer thickness of 3 μm. The resultant coating was thermally hardened to form a siloxane based resinous layer having a bridge structure. Thus Photoreceptor 1 was prepared.

Preparation of Photoreceptor 1-2

Photoreceptor 2 was prepared in the same manner as Photoreceptor 1, except that 106 g of colloidal silica (30 percent methanol solution) was added to the resinous layer coating composition of Example 1-1.

Preparation of Photoreceptor 1-3

Photoreceptor 1-3 was prepared in the same manner as Photoreceptor 1-2, except that the antioxidant in the resinous layer of Photoreceptor 1-1 was eliminated.

Preparation of Photoreceptor 1-4

Photoreceptor 1-4 was prepared in the same manner, except that the subbing layer of Photoreceptor 1-1 was eliminated.

Preparation of Photoreceptor 1-5

Photoreceptor 1-5 was prepared in the same manner as Photoreceptor 1-1, until the charge transport layer.

| •Resinous Layer | |
|---|---|
| Methyltrimethoxysilane | 150 g |
| Phenyltrimethoxysilane | 30 g |
| Compound (Exemplified Compound B-1) | 75 g |
| Antioxidant (Exemplified Compound 1–8) | 1 g |
| 2-Propanol | 225 g |
| 2 Percent acetic acid | 106 g |
| Colloidal silica (30 percent methanol solution) | 106 g |
| Trisacetylacetonatoaluminum | 4 g |

were blended and a coating composition for the resinous layer was prepared. The resultant coating composition was applied onto said charge transport layer employing a circular amount-regulating type coating apparatus to form a resinous layer having a dried layer thickness of 3 μm. The resultant coating was thermally hardened at 110° C. for one hour to form a siloxane based resinous layer having a bridge structure. Thus Photoreceptor 1-5 was prepared.

Preparation of Photoreceptor 1-6

Photoreceptor 1-6 was prepared in the same manner as Photoreceptor 1-1 until the charge transport layer.

| •Resinous Layer | |
|---|---|
| Methyltrimethoxysilane | 100 g |
| Dimethoxydimethylsilane | 53 g |
| Compound (Exemplified Compound B-1) | 45 g |
| Antioxidant (Exemplified Compound 2-1) | 1 g |
| 2-Propanol | 225 g |
| 3 Percent acetic acid | 30 g |
| Colloidal silica (30 percent methanol solution) | 80 g |
| Trisacetylacetonatoaluminum | 3 g |

were blended and the coating composition for the resinous layer was prepared. The resultant coating composition was applied onto said charge transport layer employing a circular amount-regulating type coating apparatus to form a resinous layer having a dried layer thickness of 2 μm. The resultant coating was thermally hardened at 110° C. for one hour to form a siloxane based resinous layer having a bridge structure. Thus Photoreceptor 1-6 was prepared.

Preparation of Photoreceptor 1-7

Photoreceptor 1-7 was prepared in the same manner as Photoreceptor 1-1, except that the dried layer thickness of the charge transport layer of Example 1-1 was varied to 23 μM and drying was effected without employing the resinous layer.

Preparation of Photoreceptor 1-8

Photoreceptor 1-8 was prepared in the same manner as Photoreceptor 1-1, except that the compound (Exemplified Compound B-1) in the resinous layer of Photoreceptor 1-1 was not employed.

Photoreceptor 1-9, which has a siloxane based resin containing structural units having charge transportability and is different from the photoreceptor 1-1, was prepared as follows.

| •Sublayer | |
|---|---|
| Zircoium compound (ZC-540, manufactured by Matsumoto Seiyaku) | 100 g |
| Silane compound (A1110, manufactured by NihonYunker) | 10 g |
| 1-Propanol | 400 g |
| Butanol | 200 g |

were blended and applied to a honing-processed ϕ60 mm cylindrical electrically conductive support to obtain a dried layer thickness of 0.5 μm, then it was subjected to drying at 150° C. for 10 minutes.

| •Charge Generation Layer | |
|---|---|
| X non-metal phthalocyanine | 100 g |
| Butyral resin (Eslec BM-S, manufactured by Sekisui Chemical Co., Ltd) | 100 g |
| n-Butyl acetate | 1000 g |

were mixed and dispersed by glass beads and paint shaker for one hour to prepare charge transfer layer coating composition. The composition was applied to the above mentioned support having the sublayer employing a dip coating method, then it was subjected to drying at 100° C. for 10 minutes to form a charge generation layer having a thickness of 0.2 μm.

| •Charge Transport Layer | |
|---|---|
| Charge transport material (N-(4-methylphenyl)-N-[4-{(β-diphenyl)styryl}phenyl]-p-toluidine having an IP of 5.4 eV) | 320 g |
| Polycarbonate (having a viscosity average molecular weight of 30,000) | 30 g |
| Monochlorobenzene | 200 g |

were blended and dissolved to prepare a charge transport layer coating composition. The resultant coating composition was applied onto said charge generating layer employing a dip coating method, then it was subjected to drying at 120° C. for 1 hour and a charge transport layer having a dried layer thickness of 20 μm was formed.

| •Surface protective Layer | |
|---|---|
| Phenyltriethoxysilane | 10 g |
| Silane compound (A) | 30 g |

-continued

| •Surface protective Layer | |
|---|---|
| Silicon hard coating agent (X-40-2239, manufactured by Shin-Etsu Kagaku) | 60 g |
| Ethyl acetate | 5 |

were blended to prepare a coating composition for the resinous layer. The resultant coating composition was applied onto said charge transport layer employing a circular amount-regulating type coating apparatus to form a resinous layer so as to have a dried layer thickness of 3 μm. It was subjected to drying at room temperature to form a siloxane resin based layer having cross-linking structure, and comparative photoreceptor 1-9 was prepared.

Silane compound (A)

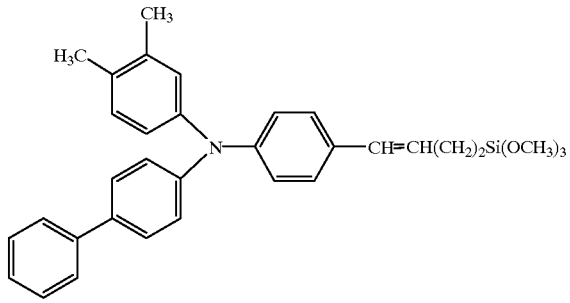

Preparation of Developer Material for Evaluation

After melt kneading a mixture consisting of 100 parts of styrene acrylic resin comprised of a weight ratio of styrene:butyl acrylate:butyl methacrylate=75:20:5, 10 parts of carbon black, and 4 parts of low molecular weight polypropylene (having a number average molecular weight of 3500), fine pulverization was carried out employing a mechanical pulverizing machine, and subsequently, classification was carried out. Thus colored particles having a volume average particle diameter of 6.6 μm were obtained.

As external additives, added were 0.4 part of hydrophobic silica particles having an average particle diameter of 12 nm and 0.6 part of titania particles having an average particle diameter of 30 nm to 100 parts of said obtained colored particles. The resultant blend was mixed at normal temperature at a circumferential speed of 40 m/second for 10 minutes, employing a Henschel mixer to obtain a negatively chargeable toner.

A ferrite carrier having a volume average particle diameter of 60 μm, which was coated with silicone resins was mixed with said toner, and the toner concentration was adjusted to 5 percent with respect to the developer material.

Evaluation

1. Evaluation of Wear Rate

After carrying out development-cleaning of 1,000 rotations, the layer thickness decrease amount was determined employing the method shown in said specific example of the measurement of the layer thickness decrease amount of the present invention, and the layer thickness decrease amount per rotation was obtained.

2. Evaluation of Residual Potential Variation Amount

The residual potential variation amount was obtained after running an electric current of 0.1 C per unit area of the photoreceptor, employing the method shown in said specific example of the measurement of the residual potential variation amount.

3. Measurement of Surface Contact Angle

The contact angle of a photoreceptor surface was measured in such a manner that after producing copies of 1,000,000 rotations, the contact angle between the surface of the photoreceptor and water was measured employing a contact angle meter (CA-DT•A Type, manufactured by Kyowa Kaimenkagaku Co.). When the photoreceptor surface is degraded, and filming occurs, the contact angle decreases due to an increase in affinity to water.

4. Evaluation of Properties

The evaluation of properties was carried out in such a manner that the present photoreceptor was installed in a digital copier, Konica 7040, manufactured by Konica Corp. (having processes of laser exposure, reversal development, claw separation, and blade cleaning), and 1,000,000 A4 plain paper sheets were continuously copied while setting the initial charge potential at −750 V.

Further, the evaluation of properties was carried out as follows. While continuously copying an original image comprised of equals of one quarter of a text pattern image, a human portrait, a solid white image and a solid black image, employing A4 sheets, the number of rotations of the photoreceptor was recorded and such copying was continued for a total of 1,000,000 rotations. At every 100,000 rotations, said photoreceptor was removed from said digital copier, and within 10 minutes, the decrease in the layer thickness as well as the residual potential was recorded. Each difference from the initial layer thickness and residual potential was divided by the number of rotations, and variation amounts were determined. Further, at every 100,000 rotations, the resultant halftone, solid white image, and solid black image were evaluated. The image density, which is utilized as the index of the residual potential variation, was obtained by measuring the density of the solid black image in terms of the absolute density, employing RD-918 manufactured by Mcbeth Co. As the residual potential increases, the image density decreases. Background stain, which is utilizes as the index of a decrease in the layer thickness was visually evaluated employing the solid white image. As a decrease in the layer thickness increases, chargeability decreases to tend to result in background stain. Further, the state of filming on the photoreceptor surface was visually evaluated. As the variation rate of the residual potential increases, filming tends to result.

Image Density

A: density of all copy images during 1,000,000 rotations was at least 1.2: being evaluated as good B: density of all copy images during 1,000,000 rotations was at least 0.8 and density of some images was between 0.8 and 1.2

C: density of at least one copy image during 1,000,000 rotations was less than 0.8.

Background Stain

A: all copy images during 1,000,000 rotations resulted in no background stain

B: some copy image during 1,000,000 rotations resulted in background stain

C: copy images during 1,000,000 rotations resulted in continuous background stain.

Visual Evaluation of Photoreceptor Surface

A: no filming occurred until 1,000,000 rotations

B: no filming occurred until 100,000 rotations

C: filming occurred at less than 100,000 rotations.

Image Problems (the black and white streaking of copy images were evaluated, while corresponding to the evaluation of filming as well as abrasion)

A: neither black streaking nor white streaking occurred in copied images during 1,000,000 rotations B: either black streaking or white streaking occurred in copy images of 1 to 10 sheets during 1,000,000 rotations C: either black streaking or white streaking occurred in copy images of at least 11 sheets during 1,000,000 rotations.

TABLE 1

| Example No. | Photo-receptor No. | Layer Thickness Decrease per Rotation (in × $10^{-6}$ $\mu$m) | Residual Potential Variation after Passing an Electric Current of 0.1 C per $cm^2$ (in V) | Contact Angle of Photo-receptor (in degrees) |
|---|---|---|---|---|
| Example 1-1 | 1-1 | 2.0 | 25 | 85 |
| Example 1-2 | 1-2 | 1.2 | 20 | 81 |
| Example 1-3 | 1-3 | 2.3 | 75 | 84 |
| Example 1-4 | 1-4 | 2.2 | 80 | 83 |
| Example 1-5 | 1-5 | 1.5 | 25 | 91 |
| Example 1-6 | 1-6 | 1.0 | 20 | 93 |
| Comparative Example 1-1 | 1-7 | 12.5 | 30 | 85 |
| Comparative Example 1-2 | 1-8 | 1.8 | 178 | 71 |
| Comparative Example 1-3 | 1-9 | 2.0 | 139 | 92 |

TABLE 2

| | Image Evaluation | | | |
|---|---|---|---|---|
| Example No. | Density | Background Stain | Surface Evaluation | Image Problems |
| Example 1-1 | A | A | B | B |
| Example 1-2 | A | A | B | A |
| Example 1-3 | B | A | B | B |
| Example 1-4 | B | A | B | B |
| Example 1-5 | A | A | A | A |
| Example 1-6 | A | A | A | A |
| Comparative Example 1-1 | A | B | C | C |
| Comparative Example 1-2 | C | A | C | B |
| Comparative Example 1-3 | C | A | C | B |

In Comparative Example 1-2, density decrease as well as filming on the photoreceptor surface occurred due to a increase in residual potential, and image problems occurred within 10 rotations. Comparative example 1-3 in which siloxane based resin having charge transportability is employed as Example 1-1, density decrease and image problems occurred due to filming on the photoreceptor though the layer thickness was reduced. This means it is important to control the variation of the residual potential. In Comparative Example 1-1, background stain occurred due to the degradation of chargeability caused by an increase in the layer thickness decrease, and further, image problems occurred due to abrasion. On the other hand, photoreceptors of the present invention resulted in excellent images even at more than 100,000 copies.

Preparation of Photoreceptors 1-9 and 1-10

Photoreceptors 1-9 and 1-10 were prepared by applying the coating compositions having the same formulas of Photoreceptors 1-1 and 1-8 onto a ϕ30 mm cylindrical electrically conductive support. Each of these photoreceptors was installed in a printer (Laser Jet 4000, manufactured by Hewlett-Packard Co.) in which the contact charging roller was employed in the charging section, and was evaluated by continuously carrying out printing of 200,000 rotations at high temperature and high humidity (30° C. and 70 percent RH). Electrophotographic properties (initial sensitivity, potential variations of the exposed and unexposed areas after printing of 200,000 rotations) were evaluated, and images were visually evaluated. Further, the layer thickness decrease amount after printing was determined.

Said properties were evaluated employing the same method as Example 1-1 (however, the criteria based on 1,000,000 rotations was varied to those based on 200,000 rotations).

TABLE 3

| Example No. | Photo-receptor No. | Layer Thickness Decrease per Rotation (in × $10^{-6}$ μm) | Residual Potential Variation after Passing an Electric Current of 0.1 C per $cm^2$ (in V) | Contact Angle of Photo-receptor (in degrees) |
|---|---|---|---|---|
| Example 1-7 | 1-9 | 3.5 | 34 | 82 |
| Comparative Example 1-3 | 1-10 | 32.5 | 30 | 71 |

TABLE 4

| | Image Evaluation | | | |
|---|---|---|---|---|
| Example No. | Density | Background Stain | Surface Evaluation | Image Problems |
| Example 1-7 | A | A | B | B |
| Comparative Example 1-3 | C | B | C | C |

Preparation of Photoreceptor 2-1

| •Sublayer | |
|---|---|
| Titanium chelate compound (TC-750, manufactured by Matsumoto Seiyaku) | 30 g |
| Silane coupling agent (KMB-503, manufactured by Shin-Etsu Kagaku) | 17 g |
| 2-Propanol | 150 ml |

were blended and applied to a ϕ60 mm cylindrical electrically conductive support to obtain a dried layer thickness of 0.5 μm.

| •Charge Generating Layer | |
|---|---|
| Y type titanyl phthalocyanine (having a maximum peak of Bragg angle 27.2 degrees with respect to Cu-α line, and an IP of 5.2 eV) | 60 g |
| Silicone modified butyral resin (X-40-1211, manufactured by Shin-Etsu Kagaku) | 700 g |
| 2-Butanone | 2000 ml |

were blended and dispersed for 10 hours, employing a sand mill to prepare a charge generating layer coating mix. The resultant mix was applied onto said sublayer, employing a dip coating method, and a charge generating layer, having a dried layer thickness of 0.2 μm, was formed.

| •Charge Transport Layer | |
|---|---|
| Charge transport material (N-(4-methylphenyl)-N-[4-{(β-diphenyl)styryl}phenyl]-p-toluidine having an IP of 5.4 eV) | 225 g |
| Polycarbonate (having a viscosity average molecular weight of 30,000) | 300 g |
| Antioxidant (Exemplified Compound 1-32) | 6 g |
| Dichloromethane | 2000 ml |

were blended and dissolved to prepare a charge transport layer coating composition. The resultant coating composition was applied onto said charge generating layer employing a dip coating method, and a charge transport layer having a dried layer thickness of 20 μm was formed. The IP difference between the charge generating material and the charge transport material was 0.2 eV.

| •Resinous Layer (Surface Layer) | |
|---|---|
| Methyltrimethoxysilane | 182 g |
| Compound (Exemplified Compound B-1) | 40 g |
| Colloidal silica (30% methanol liquid) | 106 g |
| Antioxidant (Exemplified Compound 2-1) | 1 g |
| 2-Propanol | 225 g |
| 2 Percent acetic acid | 106 g |
| Aluminum tris-acetyl acetate | 1 g |

were blended to prepare a coating composition for the resinous layer. The resultant coating composition was applied onto said charge transport layer employing a circular amount-regulating type coating apparatus to form a resinous layer having a dried layer thickness of 3 μm. The resultant coating was thermally hardened to form a siloxane based resinous layer having a bridge structure. Thus Photoreceptor 2-1 was prepared.

Preparation of Photoreceptor 2-2

Photoreceptor 2-2 was prepared in the same manner as Photoreceptor 2-1 until the charge transport layer.

| •Resinous Layer (Surface Layer) | |
|---|---|
| Methyltrimethoxysilane | 100 g |
| Dimethoxydimethylsilane | 53 g |
| Compound (Exemplified Compound B-1) | 45 g |
| Antioxidant (Exemplified Compound 1-8) | 1 g |
| 2-Propanol | 225 g |
| 3 Percent acetic acid | 30 g |
| Trisacetylacetonatoaluminum | 3 g |

were blended and the coating composition for the resinous layer was prepared. The resultant coating composition was applied onto said charge transport layer employing a circular amount-regulating type coating apparatus to form a resinous layer having a dried layer thickness of 2 μm. The resultant coating was thermally hardened at 110° C. for one hour to form a siloxane based resinous layer having a bridge structure. Thus Photoreceptor 2-2 was prepared.

Preparation of Photoreceptor 2-3

Photoreceptor 2-3 was prepared in the same manner as Photoreceptor 2-1, except that the compound (Exemplified Compound B-1) in the resinous layer (surface layer) of Photoreceptor 2-1 was not employed.

Preparation of Photoreceptor 2-4

Photoreceptor 2-4 was prepared in the same manner as Photoreceptor 2-1, except that the dried layer thickness of the charge transport layer of Example 1 was varied to 23 μm and drying was effected without employing the resinous layer at −100° C. for one hour.

Preparation of Developer Material 2-1

After melt kneading a mixture consisting of 100 parts of styrene acrylic resin comprised of a weight ratio of styrene:butyl acrylate:butyl methacrylate=75:20:5, 10 parts of carbon black, and 4 parts of low molecular weight polypropylene (having a number average molecular weight of 3500), fine pulverization was carried out employing a mechanical pulverizing machine, and subsequently, classification was carried out. Thus colored particles having a volume average particle diameter of 6.5 μm were obtained.

As external additives, added were 0.4 part of hydrophobic silica particles having an average particle diameter of 12 nm and 0.6 part of titania particles having an average particle diameter of 30 nm to 100 parts of said obtained colored particles. The resultant blend was mixed at normal temperature at a circumferential speed of 40 m/second for 10 minutes, employing a Henschel mixer to obtain a negatively chargeable toner. Fixing ratio of the external additives was 45%.

A ferrite carrier having a volume average particle diameter of 60 μm, which was coated with silicone resins was mixed with said toner, and the toner concentration was adjusted to 5 percent with respect to the developer material.

Preparation of Developer Material 2-2

As external additives, added were 0.4 part of hydrophobic silica particles having an average particle diameter of 12 nm and 0.6 part of titania particles having an average particle diameter of 30 nm, as well as 0.4 parts of titan oxide particles having number average particle diameter of 100 nm to 100 parts of said colored particles obtained by the preparation of the developer 1. The resultant blend was mixed at normal temperature at a circumferential speed of 40 m/second for 10 minutes, employing a Henschel mixer to obtain a negatively chargeable toner. Fixing ratio of the external additives was 42%.

A ferrite carrier having a volume average particle diameter of 60 μm, which was coated with silicone resins was mixed with said toner, and the toner concentration was adjusted to 5 percent with respect to the developer material 2.

Developer Material 2-2, having a toner concentration of 5 percent, was prepared by blending said toner with a ferrite carrier having a volume average particle diameter of 60 μm, which was coated with silicone resins.

Incidentally, various types of BET specific surface area, which is necessary for measuring the aforementioned adhesion ratio of external additives, were determined based on the BET one-point method, employing Flowsorb 2300, manufactured by Shimadzu Seisakusho.

Image Forming Method Employing the Aforementioned Photoreceptor and Evaluation Thereof Each of the aforementioned Photoreceptors 2-1 through 2-4, and Developer Materials 2-1 and 2-2 was installed in a Konica 7060 digital copier (comprising processes of corona charging, laser exposure, reversal development, electrostatic transfer, claw separation, cleaning utilizing a blade with an auxiliary cleaning roller) and the cleaning conditions described below were employed.

Cleaning Condition 1

A cleaning blade having a hardness of 70 degrees, an impact resilience of 34 percent, a thickness of 2 mm, and a free length of 9 mm was brought into contact with the cleaning section in the counter direction, employing a weight load system so as to obtain a linear pressure of 20 g/cm.

Cleaning Condition 2

A cleaning blade, having a hardness of 67 degrees, an impact resilience of 60 percent, a thickness of 2 mm, and a free length of 9 mm, was brought into contact with the cleaning section in the counter direction, employing a weight load system so as to obtain a linear pressure of 10 g/cm.

Image Evaluation, and Calculation of Layer Thickness Decrease Amount as well as Residual Potential Variation Amount per Rotation Image evaluation was carried out as follows. An original image, comprised of equal parts of one quarter of a text-pattern image, a human portrait, a solid white image and a solid black image, was copied onto A4 sheets at the normal position of image density (during the image formation at normal position of image density, the average toner amount adhered onto the entire surface of the photoreceptor was at least 0.5 mg/cm$^2$. Said adhered toner amount was obtained as follows. The toner which was adhered onto the photoreceptor through development, was then transferred onto adhesive tape, and the weight difference of said adhesive tape before and after the toner adhesion was determined and was then converted to a weight per unit area (in cm$^2$)). At every 100,000 rotations, the halftone image, the solid white image, and the solid black image were evaluated. While continuously copying, the number of rotations of the photoreceptor was recorded and the evaluation was continued until 1,000,000 rotations. At every 100,000 rotations, said photoreceptor was removed from said digital copier, and a decrease in the layer thickness as well as the residual potential (within 10 minutes) was recorded, employing the methods described above. Each difference from the initial layer thickness and residual potential was divided by the number of rotations, and variation amounts were determined. Further, the residual potential was determined as described above. At every 100,000 rotations for said image evaluation, light in an amount of at least 10 times the half decay exposure amount was exposed to the photoreceptor charged at 300 to 900 V in terms of the absolute value, and the surface potential was recorded between 1 second and 1 minute after said exposure, and the resultant surface potential was designated as the residual potential.

The image density, which is utilized as the index of the residual potential variation, was obtained by measuring the density of the solid black image in terms of the absolute density, employing an RD-918 manufactured by Mcbeth Co. As the residual potential increases, the image density decreases. Background stain, which is utilizes as the index of a decrease in the layer thickness, was visually evaluated employing the solid white image. As the decrease in the layer thickness becomes more pronounced, chargeability decreases tending to result in background stain. Further, the state of filming on the photoreceptor surface was visually evaluated. As the variation rate of the residual potential increases, filming tends to result.

Measurement of the Surface Contact Angle

The contact angle of the photoreceptor surface was measured in such a manner that after producing copies of 1,000,000 rotations, the contact angle between the surface of the photoreceptor and water was measured employing a contact angle meter (CA-DT•A Type, manufactured by Kyowa Kaimenkagaku Co.). When the photoreceptor surface is degraded, and filming occurs, the contact angle decreases due to an increase in affinity with water.

Image Density

A: density of all copy images during 1,000,000 rotations was at least 1.2: being evaluated as good B: density of all copy images during 1,000,000 rotations was at least 0.8 and density of some images was between 0.8 and 1.2

C: density of at least one copy image during 1,000,000 rotations was less than 0.8.

Background Stain

A: all copy images during 1,000,000 rotations resulted in no background stain

B: some copy image during 1,000,000 rotations resulted in background stain

C: copy images during 1,000,000 rotations resulted in continuous background stain.

Visual Evaluation of Photoreceptor Surface

A: no filming occurred until 1,000,000 rotations

B: no filming occurred until 100,000 rotations

C: filming occurred at less than 100,000 rotations.

Image Problems (the black and white streaking of copy images were evaluated, while corresponding to the evaluation of filming as well as abrasion)

A: neither black streaking nor white streaking occurred in copied images during 1,000,000 rotations B: either black streaking or white streaking occurred in copy images of 1 to 10 sheets during 1,000,000 rotations C: either black streaking or white streaking occurred in copy images of at least 11 sheets during 1,000,000 rotations.

Measurement of surface contact angle

Surface contact angle of deionized water to the photoreceptor after copying of 1,000,0000 rotations were measured by a contact angle measure apparatus (CA-DT A product by Kyowa Kaimen Kagaku Co.). The contact angle reduces when the surface of the photoreceptor deteriorates or filming due to paper powder generates, because affinity to water increases.

TABLE 5

| Example No. | Cleaning Condition | Toner No. | Photo recep-tor No. | Per Rotation of Photoreceptor: Layer Thickness Decrease Amount (in × $10^{-6}$ μm) | Per Rotation of Photoreceptor: Residual Potential Variation Amount (in × $10^{-5}$ V) | Contact Angle of Photo-receptor Surface (in degrees) |
|---|---|---|---|---|---|---|
| Example 2-1 | 1 | 2-1 | 2-1 | 1.6 | 0.4 | 83 |
| Example 2-2 | 2 | 2-1 | 2-1 | 1.2 | 0.4 | 80 |
| Example 2-3 | 1 | 2-2 | 2-1 | 2.2 | 0.35 | 86 |
| Example 2-4 | 1 | 2-2 | 2-2 | 2.0 | 0.35 | 93 |
| Compara-tive Example 2-1 | 1 | 2-1 | 2-3 | 0.7 | 2.5 | 71 |
| Compara-tive Example 2-2 | 1 | 2-2 | 2-4 | 14.0 | 0.4 | 82 |

TABLE 6

| Example No. | Image Evaluation: Density | Image Evaluation: Background Stain | Image Evaluation: Evaluation of Photoreceptor Surface | Image Evaluation: Evaluation of Image Problems |
|---|---|---|---|---|
| Example 2-1 | A | A | B | A |
| Example 2-2 | A | A | B | A |
| Example 2-3 | A | A | B | A |
| Example 2-4 | A | A | A | A |
| Comparative Example 2-1 | C | C | C | C |
| Comparative Example 2-2 | C | C | C | C |

As can be seen from Tables 5 and 6, Examples, which satisfy requirements of the present invention, minimize the layer thickness decrease amount as well as the residual potential increase and further, exhibit excellent performance obtained by image evaluation through the image formation of 1,000,000 rotations. Contrary to this, Comparative Examples, which do not satisfy requirements of the present invention, exhibits insufficient properties of either the layer thickness decrease amount or the residual potential increase, and further do not exhibit sufficient properties as to image evaluation.

The photoreceptor of the present invention exhibits more pronounced effects when processes such as a contact charging system, and the like, are employed which tend to damage said photoreceptor.

As can clearly be seen from examples described above, according to the present invention, techniques which have made it possible to market a electrophotographic photoreceptor which sufficiently meets requirement for both wear resistance and electrophotographic properties under the repeated formation of electrophotographic images is firstly developed. Thus, it has been achieved to prepare an organic electrophotographic photoreceptor, which is durable for the production of 1,000,000 copies, an electrophotographic image forming method as well as an electrophotographic image forming apparatus employing said photoreceptor, and a processing cartridge employed in said apparatus.

What is claimed is:

1. An electrophotographic photoreceptor comprising a cylindrical electrically conductive support having thereon a plurality of layers, wherein layer thickness decreasing amount ΔHd (in μm) is $0 \leqq \Delta Hd < 5 \times 10^{-6}$ per rotation, and residual potential variation amount is $0 \leqq \Delta Vr < 100$ (in V) in case that an electric current corresponding to 0.1 C/cm$^2$ is provided to a surface of said photoreceptor by charging and exposure.

2. The electrophotographic photoreceptor of claim 1 wherein one of a plurality of said resinous layers is a surface layer, and said surface layer comprises a siloxane based resin containing structural units having charge transportability.

3. The electrophotographic photoreceptor of claim 2 wherein said surface layer comprises colloidal silica.

4. The electrophotographic photoreceptor of claim 2 wherein said surface layer comprises an antioxidant.

5. The electrophotographic photoreceptor of claim 2 wherein the cylindrical electrically conductive support comprises thereon a sublayer, a charge generating layer, a charge transport layer and said surface layer.

6. The electrophotographic photoreceptor of claim 5 wherein said charge generating layer comprises titanyl phthalocyanine having a maximum peak at Bragg angle of 27.2 degrees with respect to the Cu-Kα line.

7. The electrophotographic photoreceptor of claim 1 wherein the contact angle between the surface of the photoreceptor and water is at least 90 degrees.

8. An electrophotographic image forming method comprising process of charging, image exposure, development, transfer and cleaning utilizing a blade, and employing an electrophotographic photoreceptor which comprises a cylindrical electrically conductive support having thereon a plurality of resinous layers, wherein when the image forming process is carried out by rotating said electrophotographic photoreceptor more than 300,000 times under conditions in which average toner amount adhered onto entire surface of said electrophotographic photoreceptor through development during said development process is at least 0.5 $mg/cm^2$, a layer thickness decrease amount $\Delta Hd$ (in $\mu m$) per rotation is $0 \leqq \Delta Hd < 3\times10^{-6}$, and residual potential variation amount $\Delta Vr$ (in V) per rotation is $0 \leqq \Delta Vr < 1\times10^{-5}$.

9. The electrophotographic photoreceptor of claim 8 wherein one of said plurality of layers is a surface layer comprising siloxane based resin having structural units exhibiting charge transportability.

10. The electrophotographic image forming method of claim 8 wherein the cleaning blade, which is employed in said blade cleaning process, has a hardness of 65 to 75 degrees and an impact resilience of 15 to 60 percent, and is brought into contact with said photoreceptor under a linear pressure of 5 to 50 g/cm.

11. The electrophotographic image forming method of claim 8 wherein toner of a developer material employed in said development process is blended with powder having a number average particle diameter of 10 to 300 nm as the external additive and external additive adhesion ratio Fd is between 10 and 90 percent,
wherein $$Fd=[1-\{Sw_1-Sw_2\}/Sw_3]]\times100$$

in the formula $Sw_1$ is the BET specific surface area (in $m^2/g$) of toner adhered to the external additive, $Sw_2$ is the BET specific surface area (in $m^2/g$) of toner prior to the addition of the external additive, and $Sw_3$ is the BET specific surface area (in $m^2/g$) of the external additive.

12. The electrophotographic image forming method of claim 8 wherein toner of the developer material employed in said development process is blended with powder having an average particle diameter of not more than 50 nm, and with powder having an average particle diameter of at least 60 nm in combination as the external additives.

13. The electrophotographic image forming method of claim 8 wherein said development process employs the reversal development system.

14. The electrophotographic photoreceptor of claim 9 wherein said surface layer comprises colloidal silica.

15. The electrophotographic photoreceptor of claim 9 wherein said surface layer comprises an antioxidant.

16. The electrophotographic photoreceptor of claim 8 wherein the cylindrical electrically conductive support comprises thereon a sublayer, a charge generating layer, a charge transport layer and a surface layer.

17. The electrophotographic photoreceptor of claim 16 wherein said charge generating layer comprises titanyl phthalocyanine having a maximum peak at Bragg angle of 27.2 degrees with respect to the Cu-K$\alpha$ line.

18. The electrophotographic photoreceptor of claim 8 wherein the contact angle between the surface of the photoreceptor and water is at least 90 degrees.

19. The electrophotographic image forming method of claim 8 wherein said electrophotographic photoreceptor is repeatedly employed over at least 1,000,000 rotations for forming images.

20. An electrophotographic image forming apparatus comprising charging member, image exposure member, development member, transfer member and cleaning member utilizing a blade, and an organic electrophotographic photoreceptor which comprises a cylindrical electrically conductive support, having thereon a photosensitive layer, wherein when image forming process is carried out by rotating said electrophotographic photoreceptor more than 300,000 times under the conditions in which an average toner amount, adhered onto an entire surface of said electrophotographic photoreceptor comprising said surface layer, is at least 0.5 $mg/cm^2$, through development of said development means, a layer thickness decrease amount $\Delta Hd$ (in $\mu m$) per rotation is $0 \leqq \Delta Hd < 3\times10^{-6}$, and residual potential variation amount $\Delta Vr$ (in V) per rotation is $0 \leqq \Delta Vr < 1\times10^{-5}$.

21. The electrophotographic image forming apparatus of claim 20 wherein one of said plurality of layers is a surface layer comprising siloxane based resin having structural units exhibiting charge transportability.

* * * * *